US009841693B2

(12) United States Patent
Sugawara et al.

(10) Patent No.: US 9,841,693 B2
(45) **Date of Patent: *Dec. 12, 2017**

(54) BRILLIANT TONER, ELECTROSTATIC CHARGE IMAGE DEVELOPER, AND TONER CARTRIDGE

(71) Applicant: FUJI XEROX CO., LTD., Tokyo (JP)

(72) Inventors: Atsushi Sugawara, Kanagawa (JP); Sakiko Hirai, Kanagawa (JP); Masaru Takahashi, Kanagawa (JP); Satomi Hara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/215,188

(22) Filed: Jul. 20, 2016

(65) Prior Publication Data

US 2017/0227873 A1 Aug. 10, 2017

(30) Foreign Application Priority Data

Feb. 10, 2016 (JP) ..... 2016-024144

(51) Int. Cl.

| | |
|---|---|
| ***G03G 9/08*** | (2006.01) |
| ***G03G 9/09*** | (2006.01) |
| ***G03G 15/08*** | (2006.01) |
| ***G03G 9/093*** | (2006.01) |
| ***G03G 9/087*** | (2006.01) |

(52) U.S. Cl.

CPC ..... *G03G 9/0902* (2013.01); *G03G 9/0821* (2013.01); *G03G 9/08782* (2013.01); *G03G 9/0926* (2013.01); *G03G 9/09307* (2013.01); *G03G 15/0865* (2013.01)

(58) Field of Classification Search

CPC . G03G 9/0902; G03G 9/0926; G03G 9/08782
USPC ..... 430/107.1, 108.1, 108.8
See application file for complete search history.

(56) References Cited

U.S. PATENT DOCUMENTS

| | | | | |
|---|---|---|---|---|
| 9,529,288 | B1 * | 12/2016 | Sugawara | G03G 9/08 |
| 2011/0318063 | A1 | 12/2011 | Takahashi et al. | |
| 2011/0318682 | A1 | 12/2011 | Takahashi et al. | |

(Continued)

FOREIGN PATENT DOCUMENTS

| | | | |
|---|---|---|---|
| JP | 2012-032765 | A | 2/2012 |
| JP | 2012-208142 | A | 10/2012 |

(Continued)

*Primary Examiner* — Mark A Chapman
(74) *Attorney, Agent, or Firm* — Oliff PLC

(57) ABSTRACT

A brilliant toner includes release agent domains meeting conditions (1) a length of the release agent domain in a longitudinal axis direction is 300 nm to 1,500 nm, (2) a ratio between the length in the longitudinal axis direction and in a short axis direction of the release agent domain is 3.0 to 15.0, (3) an angle between (a) a tangent line passing through a contact point of (a1) a circumference of a circle that is centered at a centroid of the release agent domain and is inscribed in an outer edge of the toner particle and (a2) the outer edge and (b) a line passing through the centroid and extending in the longitudinal axis direction is 0° to 45°, and (4) a ratio of a distance between the centroid and the contact point to an equivalent circle diameter of the toner particle is 0.03 to 0.25.

9 Claims, 7 Drawing Sheets

(56) References Cited

U.S. PATENT DOCUMENTS

| | | | |
|---|---|---|---|
| 2012/0237868 | A1 | 9/2012 | Yamada et al. |
| 2014/0045113 | A1 | 2/2014 | Takahashi et al. |

FOREIGN PATENT DOCUMENTS

| | | | |
|---|---|---|---|
| JP | 2013-057906 | A | 3/2013 |
| JP | 2014-038131 | A | 2/2014 |

* cited by examiner

BRILLIANT TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2016-024144 filed Feb. 10, 2016.

BACKGROUND

1. Technical Field

The present invention relates to a brilliant toner, an electrostatic charge image developer, and a toner cartridge.

2. Related Art

A brilliant toner has been used for the purpose of forming an image with gloss such as metallic luster.

SUMMARY

According to an aspect of the invention, there is provided a brilliant toner including:

toner particles that contain a brilliant pigment and a release agent, wherein the release agent forms release agent domains that meet the following conditions (1) to (4);

Condition (1): a length of the release agent domain in a longitudinal axis direction is from 300 nm to 1,500 nm;

Condition (2): a ratio between the length in the longitudinal axis direction and the length in a short axis direction of the release agent domain (the length in the longitudinal axis direction/the length in the short axis direction) is from 3.0 to 15.0;

Condition (3): an angle θ between (a) a tangent line passing through a contact point of (a1) a circumference of a circle that is centered at a centroid of the release agent domain and is inscribed in an outer edge of the toner particle and (a2) the outer edge and (b) a line passing through the centroid of the release agent domain and extending in the longitudinal axis direction of the release agent domain is from 0° to 45°; and Condition (4): a ratio of a distance A between the centroid of the release agent domain and the contact point to an equivalent circle diameter of the toner particle (distance A/equivalent circle diameter) is from 0.03 to 0.25.

BRIEF DESCRIPTION OF THE DRAWINGS

Exemplary embodiments of the present invention will be described in detail based on the following figures, wherein.

DETAILED DESCRIPTION

Hereinafter, detailed description will be given of a brilliant toner, an electrostatic charge image developer, a toner cartridge, a process cartridge, an image forming apparatus, and an image forming method according to an exemplary embodiment of the invention.

Brilliant Toner

A brilliant toner according to an exemplary embodiment (hereinafter, simply referred to as a "toner" in some cases) includes a brilliant pigment and a release agent and contains toner particles in which the release agent forms a release agent domain that meets the following conditions (1) to (4).

Hereinafter, the release agent domain that meets the conditions (1) to (4) will be referred to as a specific release agent domain.

Condition (1): A length of each release agent domain in a longitudinal axis direction is from 300 nm to 1500 nm.

Condition (2): A ratio between the length in the longitudinal axis direction and the length in a short axis direction of the release agent domain (the length in the longitudinal axis direction/the length in the short axis direction) is from 3.0 to 15.0.

Condition (3): An angle θ between (a) a tangent line passing through a contact point of (a1) a circumference of a circle that is centered at a centroid of the release agent domain and is inscribed in an outer edge of the toner particle and (a2) the outer edge and (b) a line passing through the centroid of the release agent domain and extending in the longitudinal axis direction of the release agent domain is from 0° to 45°.

Condition (4): A ratio between an equivalent circle diameter of the toner particle and a distance A between the centroid of the release agent domain and the contact point (distance A/equivalent circle diameter) is from 0.03 to 0.25.

First, description will be given of a relationship between the toner particle and the release agent domain according to the exemplary embodiment with reference to drawings.

Figure 1:
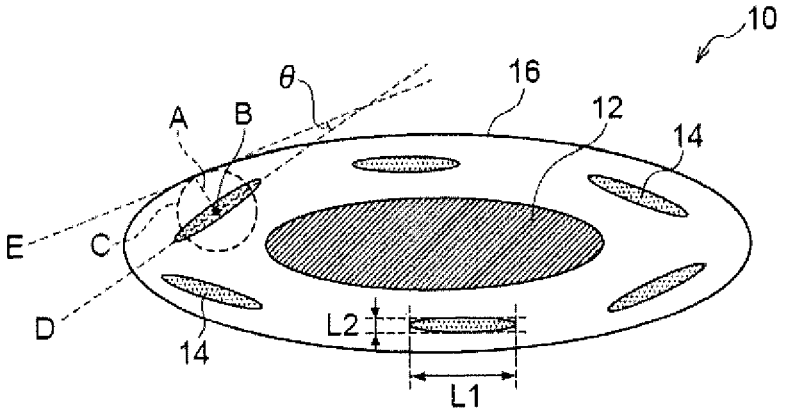
FIG. 1 is a sectional view of a first aspect of brilliant toner according to an exemplary embodiment.

FIG. 1 is a sectional view of a first aspect of the toner according to the exemplary embodiment. A brilliant toner 10 according to the first aspect includes a brilliant pigment particle 12 and multiple release agent domains 14 in each toner particle 16, In the brilliant toner 10 according to the first aspect, all the shapes of the toner particle 16, the brilliant pigment particle 12, and the specific release agent domains 14 are flake shapes (hereinafter, referred to as "flake" in some cases). The release agent domains 14 have a length L1 in the longitudinal axis direction and a length L2 in the short axis direction.

The circle that is centered at a centroid B of each release agent domain 14 and is inscribed in the outer edge of the toner particle 16 is represented as a circle C in FIG. 1. A radius of the circle C, that is, a distance between the contact point at which the circle C is inscribed in the outer edge of the toner particle 16 and the centroid B is regarded as a distance A. The line passing through the centroid B of each release agent domain 14 and extending in the longitudinal axis direction of the release agent domain 14 is regarded as a line D. The tangent line passing through the contact point between the circumference of the circle C and the outer edge of the toner particle 16 is regarded as a line E. The angle between the line D and the line E is regarded as θ. θ corresponds to the angle θ in the above condition (3).

Here, a toner that includes a brilliant pigment (such as metal pigment) and a release agent in the toner particles is used as a brilliant toner in many cases in the related art.

The brilliant pigment (such as metal pigment) is harder than ordinary pigments and has a. characteristic that the pigment tends to be exposed to the surfaces of toner particles. Therefore, when a toner image is transferred from an image holding member (hereinafter, photoreceptor) to a transfer section (such as an intermediate transfer member) in a case of forming an image by using the brilliant toner, stress tends to be applied between the photoreceptor and a transfer member (transfer unit) and friction tends to occur at the transfer unit. Therefore, cracks are likely to be caused on the surface of the photoreceptor, and gloss unevenness of a fixed image tends to occur.

In contrast, the brilliant toner according to the exemplary embodiment includes a brilliant pigment and a release agent in a toner particle and has a structure in which the release agent forms a release agent domain (specific release agent domain) that meets the conditions (1) to (4).

Thus, the gloss unevenness in the fixed image due to the crack on the surface of the photoreceptor is prevented. The reason is inferred as follows though not clear.

Each of specific release agent domains is a flake-shaped release agent domain that has a specific size and shape (conditions (1) and (2)). In addition, the specific release agent domains are arranged along the surface of the toner particle (condition (3)) and are present on the surface side of the toner particle (condition (4)).

By employing the above size, shape, and the arrangement structure, the specific release agent domains are arranged so as to cover the periphery of the brilliant pigment and tend to be present on the surface side of the toner particle along the surface of the toner particle. Accordingly, lubricity (slipperiness) of the surface of the toner particle is considered to be enhanced. As a result, it is considered that friction between the photoreceptor and the transfer member is prevented when the toner image is transferred, and occurrence of crack on the surface of the photoreceptor is prevented.

According to the brilliant toner of the exemplary embodiment, occurrence of crack on the surface of the photoreceptor is prevented, and gloss unevenness in a fixed image is prevented even if the brilliant pigment that is harder than ordinary pigments is contained as described above.

The crack on the surface of the photoreceptor tends to remarkably occur when an image is formed at a high speed in a high-moisture environment.

However, according to the brilliant toner of the exemplary embodiment, the gloss unevenness in a fixed image due to crack on the surface of the photoreceptor is prevented even if the image formation is performed at a high speed in the high-moisture environment.

Furthermore, according to the brilliant toner of the exemplary embodiment, a bleeding property of the release agent when a toner image is fixed is enhanced due to the specific release agent domains with the above size, shape, and arrangement structure. The bleeding property of the release agent affects glossiness of the fixed image. Specifically, if the bleeding amount of the release agent varies among the toner particles, gloss unevenness in the fixed image tends to occur.

However, according to the brilliant toner of the exemplary embodiment, gloss unevenness in the fixed image due to the bleeding property of the release agent is also prevented.

Hereinafter, preferable ranges of the above conditions (1) to (4) of the release agent domains are as follows in terms of preventing occurrence of crack on the surface of the photoreceptor and preventing gloss unevenness in the fixed image due to the crack on the surface of the photoreceptor, in the brilliant toner according to the exemplary embodiment.

Condition (1)

The length of each release agent domain in the longitudinal axis direction defined in the condition (1) is from 300 nm to 1500 nm, preferably from 400 nm to 1,200 nm, and further preferably from 500 nm to 1,200 nm.

Condition (2)

The ratio (the length in the longitudinal axis direction/the length in the short axis direction) of the release agent domain defined in the condition (2) is from 3.0 to 15.0, preferably from 3.0 to 12.0, and further preferably from 4.0 to 12.0.

Condition (3)

The angle 0 of the release agent domain defined in the condition (3) is from 0° to 45°, preferably from 0° to 30°, and further preferably from 0° to 25°.

Here, the angle θ is an index that indicates how much the arrangement of the release agent domain is inclined with respect to the surface of the toner particle. Therefore, the angle θ of the release agent domain within the above range means that the release agent domain is arranged along the surface of the toner particle (in a nearly parallel state).

Condition (4)

The ratio (distance A/equivalent circle diameter) defined in the condition (4) is from 0.03 to 0.25, preferably from 0.03 to 0.20, and further preferably from 0.03 to 0.15.

Here, the ratio (distance A/equivalent circle diameter) is an index that indicates how close the release agent domain is with respect to the surface side of the toner particle. Therefore, the ratio (distance A/equivalent circle diameter) within the above range means that the release agent domain is present near the surface side of the toner particle.

In this embodiment, whether or not the release agent domain contained in the toner particle meets the conditions (1) to (4) is calculated from an observed image obtained by observing a section of the toner particle.

The section of the toner particle is observed by a method of observing the section of the toner particle (or toner, the same is true for the following description) by a transmission electron microscope or a method of dyeing the section of the toner particle with ruthenium tetraoxide and observing the section by a scanning electron microscope (SEM), for example. It is preferable to perform the observation by the scanning electron microscope since the release agent domain in the section of the toner particle may be more clearly observed.

Any scanning electron microscope may be employed as long as the model is well known by those skilled in the art, and examples thereof include SU8020 manufactured by Hitachi High-Technologies Corporation and JSM-7500F manufactured by JEOL Ltd.

A specific observation method is as follows. First, a toner particle to be measured is embedded in epoxy resin, and then the epoxy resin is hardened. The hardened substance is cut into thin pieces by a microtome provided with a diamond blade, and an observation sample with the exposed section of the toner particle is obtained. The thin observation sample is dyed with ruthenium tetraoxide, and the section of the toner particle is observed by a scanning electron microscope. By the observation method, the release agent with a difference in luminance (contrast) is observed in continuous phases of a binder resin in the section of the toner particle due to a difference in degrees of the dyeing.

Next, description will be given of methods of obtaining the length of each release agent domain in the longitudinal axis direction defined in the condition (1), the ratio (the length in the longitudinal axis direction/the length in the short axis direction) defined in the condition (2), and the angle θ defined in the condition (3), namely the angle θ between the tangent line passing through a contact point of a circumference of a circle that is centered at the centroid of the release agent domain and is inscribed in the outer edge of the toner particle and the outer edge and a line passing through the centroid of the release agent domain and extending in the longitudinal axis direction of the release agent domain.

First, an image is recorded at such a magnification that a section of a single toner particle is within a field of view. The recorded image is analyzed by image analysis software (WINROOF manufactured by Mitani Corporation) under a condition of 0.010000 μm/pixel. By the image analysis, the image of the section of the toner particle may be observed due to the difference in luminance (contrast) between the epoxy resin used in the embedding and the binder resin in the toner particle. Based on the observed image, the length of the release agent domain in the longitudinal axis direction in the toner particle and the ratio (the length in the longitudinal axis direction/the length in the short axis direction) may be obtained.

Then, as for the position of the centroid of the extracted release agent domain, an x coordinate of the centroid may be obtained by dividing the sum of values of the respective xi coordinates by n, and a y coordinate of the centroid may be obtained by dividing the sum of values of the respective yi coordinates by n where n represents the number of pixels in a region corresponding to the extracted toner particle or the release agent domain region, and xy coordinates of the respective pixels are xi, yi (i=1, 2, . . . , n), from the difference in luminance (contrast) between the binder resin and the release agent.

It is possible to obtain, from the obtained centroid and the observed image, the angle θ between the tangent line passing through a contact point of a circumference of a circle that is centered at the centroid of the release agent domain and is inscribed in the outer edge of the toner particle and the outer edge and the line passing through the centroid of the release agent domain and extending in the longitudinal axis direction of the release agent domain.

Next, description will be given of a method of obtaining the ratio (distance A/equivalent circle diameter) defined in the condition (4), namely the ratio (distance A/equivalent circle diameter) between the equivalent circle diameter of the toner particle and the distance A between the centroid of the release agent domain and the contact point (the contact point in the condition (3)).

The equivalent circle diameter of the toner particle is calculated by the following method of measuring the average equivalent circle diameter D. The distance A between the centroid of the release agent domain and the contact point may be obtained from the observed image by the method. The ratio (distance A/equivalent circle diameter) may be obtained from the obtained equivalent circle diameter of the toner particle and the distance A between the centroid of the release agent domain and the contact point.

In the exemplary embodiment, the rate of the toner particles with the specific release agent domains with respect to the entire toner particles is preferably equal to or greater than 30% by number, more preferably equal to or greater than 40% by number, and further preferably equal to or greater than 50% by number. If the rate of the toner particles with the specific release agent domains with respect to the entire toner particles is equal to or greater than 30% by number, lubricity (slipperiness) of the surfaces of the toner particles is enhanced, and gloss unevenness in the fixed image due to crack on the surface of the photoreceptor is further prevented.

Examples of a method of adjusting the range of the toner particles with the specific release agent domains with respect to the entire toner particles within the above range include a method of controlling the content of the release agent in the toner particles and a method of controlling a temperature after the temperature is increased again in the process of preparing the toner, which will be described later, and the temperature increasing speed at the time of increasing the temperature again.

In the exemplary embodiment, the number of toner particles to be evaluated for calculating the rate of the toner particles with the specific release agent domains with respect to the entire toner particles is equal to or greater than 100.

Hereinafter, description will be given of second to eighth aspects as other aspects of the brilliant toner according to the exemplary embodiment with reference to drawings.

In the brilliant toner according to the above first aspect and the brilliant toners according to the following second to eighth aspects, the numbers and the orientation states of the brilliant pigment particles contained in the toner particles and the numbers of the specific release agent domains are not particularly limited.

Second Aspect

Figure 2A:
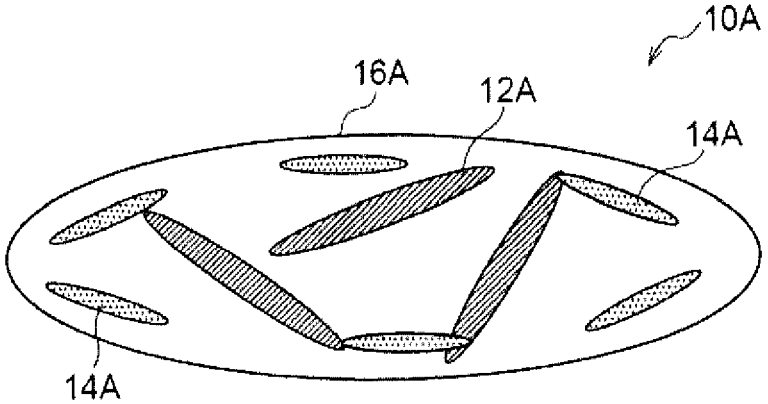
FIG. 2A is a sectional view of another aspect of the brilliant toner according to the exemplary embodiment.

FIG. 2A is a sectional view of the second aspect of the brilliant toner according to the exemplary embodiment. A brilliant toner 10A includes multiple brilliant pigment particles 12A and multiple specific release agent domains 14A in each toner particle 16A. In the brilliant toner 10A according to the second aspect, all the toner particle 16A, the brilliant pigment particles 12A, and the specific release agent domains 14A are flake shapes.

By using the brilliant toner 10A according to the second aspect to form an image, gloss unevenness in a fixed image due to crack on the surface of the photoreceptor is prevented.

Arrangement of the brilliant pigment particles 12A in each toner particle 16A is not particularly limited. The respective brilliant pigment particles 12A illustrated in FIG. 2A are arranged such that angles between the longitudinal axis directions of the brilliant pigment particles 12A and the longitudinal axis direction of the toner particle become random. However, the brilliant pigment particles 12A may be arranged such that the above angle is from 0° to 45° (preferably from 0° to 30°). That is, the multiple brilliant pigment particles 12A may be arranged along the longitudinal axis direction of the toner particle (that is, the multiple brilliant pigment particles 12A may be oriented on the side of the longitudinal axis direction).

Third aspect

Figure 2B:
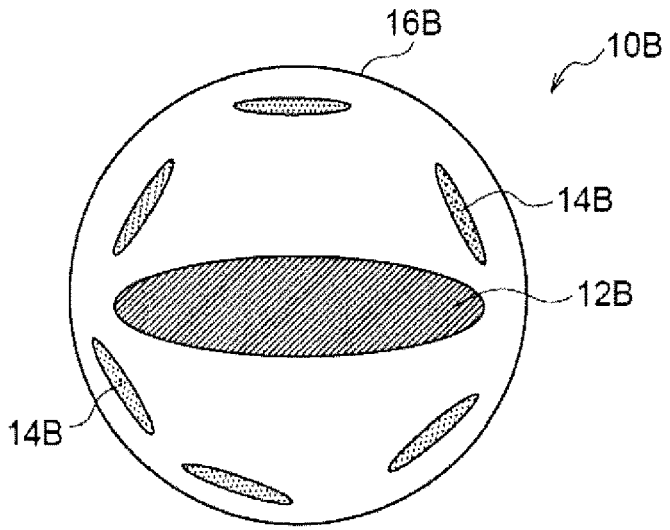
FIG. 2B is a sectional view of another aspect of the brilliant toner according to the exemplary embodiment.

FIG. 2B is a sectional view of the third aspect of the brilliant toner according to the exemplary embodiment. A brilliant toner 10B includes a brilliant pigment particle 12B and multiple specific release agent domains 14B in each toner particle 16B. In the brilliant toner 10B according to the third aspect, the shape of the toner particle 16B is a circular shape, and the shapes of the brilliant pigment particle 123 and the specific release agent domains 14B are flake shapes.

By using the brilliant toner 10B according to the third aspect to form an image, gloss unevenness in the fixed image due to crack on the surface of the photoreceptor is prevented.

Fourth Aspect

Figure 2C:
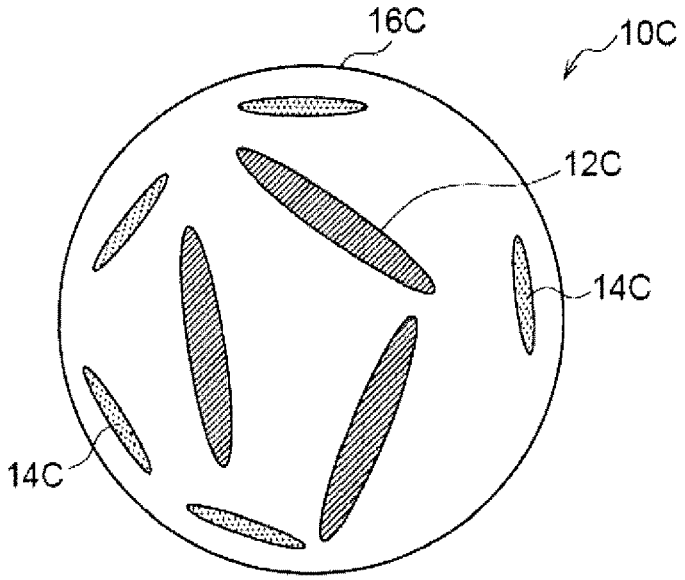
FIG. 2C is a sectional view of another aspect of the brilliant toner according to the exemplary embodiment.

FIG. 2C is a sectional view of the fourth aspect of the brilliant toner according to the exemplary embodiment. A brilliant toner 10C includes multiple brilliant pigment particles 12C and multiple specific release agent domains 14C in each toner particle 16C. In the brilliant toner 10C according to the fourth aspect, the shape of the toner particle 16C is a circular shape, and the shapes of the brilliant pigment particles 12C and the specific release agent domains 14C are flake shapes.

By using the brilliant toner 10C according to the fourth embodiment to form an image, gloss unevenness in the fixed image due to crack on the surface of the photoreceptor is prevented.

The arrangement of the brilliant pigment particles 12C in each toner particle 16C is not particularly limited. Although the respective brilliant pigment particles 12C are arranged in random in FIG. 2C, for example, the brilliant pigment particles 12C may be arranged such that angles between the longitudinal axis directions of the multiple brilliant pigment particles 12C are from 0° to 45° (preferably from 0° to 30°). That is, the multiple brilliant pigment particles 12C may be arranged in a nearly parallel state with respect to each other.

Fifth Aspect

Figure 2D:
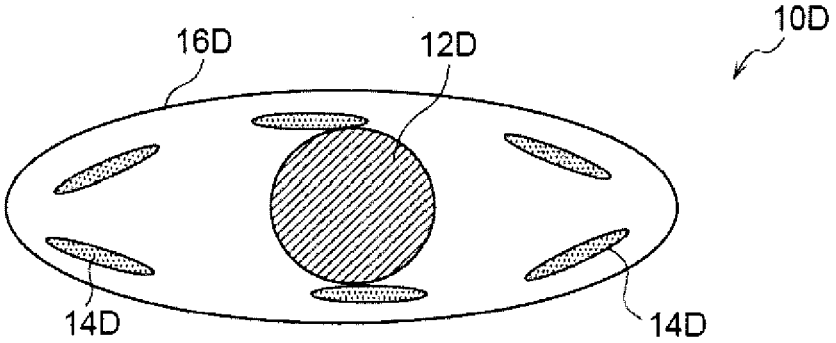
FIG. 2D is a sectional view of another aspect of the brilliant toner according to the exemplary embodiment.

FIG. 2D is a sectional view of the fifth aspect of the brilliant toner according to the exemplary embodiment. A brilliant toner 10D includes a brilliant pigment particle 12D and multiple specific release agent domains 14D in each toner particle 16D. In the brilliant toner 10D according to the fifth embodiment, the shapes of the toner particle 16D and the specific release agent domains 14D are flake shapes, and the shape of the brilliant pigment particle 12D is a circular shape.

By using the brilliant toner 10D according to the fifth aspect to form an image, gloss unevenness in the fixed image due to crack on the surface of the photoreceptor is prevented.

Sixth Aspect

Figure 2E:
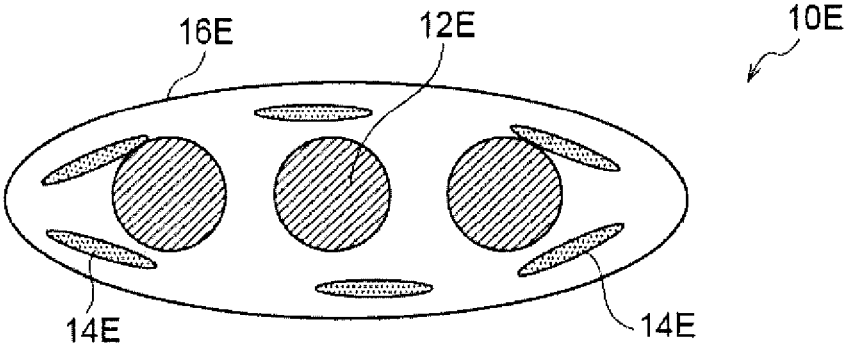
FIG. 2E is a sectional view of another aspect of the brilliant toner according to the exemplary embodiment.

FIG. 2E is a sectional view of a sixth aspect of the brilliant toner according to the exemplary embodiment. A brilliant toner 10E includes multiple brilliant pigment particles 12E and multiple specific release agent domains 14E in each toner particle 16E. In the brilliant toner 10E according to the sixth aspect, the shapes of the toner particle 16E and the specific release agent domains 14E are flake shapes, and the shape of the brilliant pigment particles 12E is a circular shape.

By using the brilliant toner 10E according to the sixth aspect to form an image, gloss unevenness in the fixed image due to crack on the surface of the photoreceptor is prevented.

Seventh Aspect

Figure 2F:
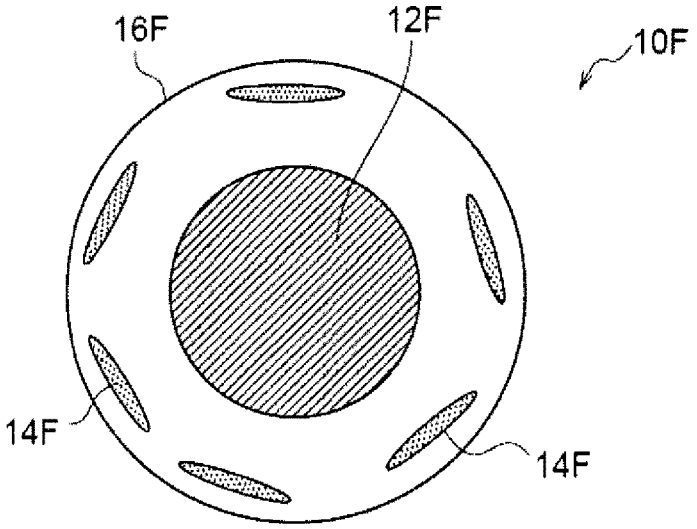
FIG. 2F is a sectional view of another aspect of the brilliant toner according to the exemplary embodiment.

FIG. 2F is a sectional view of the seventh aspect of the brilliant toner according to the exemplary embodiment. A brilliant toner 10F includes a brilliant pigment particle 12F and multiple specific release agent domains 14F in each toner particle 16F. In the brilliant toner 10F according to the seventh aspect, the shapes of the toner particle 16F and the brilliant pigment particle 12F are circular shapes, and the shape of the specific release agent domains 14F is a flake shape.

By using the brilliant toner 10F according to the seventh aspect to form an image, gloss unevenness in the fixed image due to crack on the surface of the photoreceptor is prevented.

Eighth Aspect

Figure 2G:
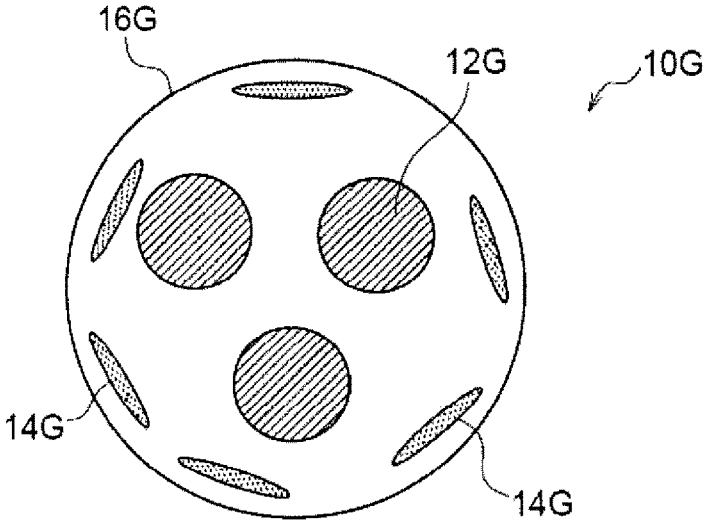
FIG. 2G is a sectional view of another aspect of the brilliant toner according to the exemplary embodiment.

FIG. 2G is a sectional view of the eighth aspect of the brilliant toner according to the exemplary embodiment. A brilliant toner 10G includes multiple brilliant pigment particles 12G and multiple specific release agent domains 14G in each toner particle 16G. In the brilliant toner 10G according to the eighth aspect, the shapes of the toner particle 16G and the brilliant pigment particles 12G are circular shapes, and the shape of the specific release agent domains 14G is a flake shape.

By using the brilliant toner 10G according to the eighth aspect to form an image, gloss unevenness in the fixed image due to crack on the surface of the photoreceptor is prevented.

Although the brilliant toners according to the first to eighth aspects were described above, the shapes of the toner particles and the brilliant pigment particles are not limited to the above shapes, and for example, distorted shapes or shapes with unevenness may be employed. That is, the shapes of the toner particles and the brilliant pigment particles may be irregular shapes.

The "brilliance" of the toner according to the exemplary embodiment means gloss such as metallic luster observed when an image formed by the brilliant toner according to the exemplary embodiment is visually recognized.

Specifically, examples of the brilliant toner include brilliant toner that has a ratio (A/B) from 2 to 100 between the reflectance A at the light receiving angle of +30° and the reflectance B at the light receiving angle of −30° measured in a case where a solid image is formed and the solid image is irradiated with incident light with an incident angle of −45° by a varied-angle photometer.

The ratio (A/B) of equal to or greater than 2 represents that reflection on the opposite side (positive angle side) to the incident side is greater than reflection on the incident side (minus angle side) on which the incident light is incident, that is, scattered reflection of the incident light is prevented. In a case in which scattered reflection of incident light in various directions occurs, the reflected light is observed to have a dull-hued color in visual recognition. Therefore, luster may be observed in the visual recognition of the reflected light and excellent brilliance is achieved in a case where the ratio (A/B) is equal to or greater than 2.

In contrast, if the ratio (A/B) is equal to or less than 100, a view angle in which the reflected light may be visually recognized does not become excessively narrow. Therefore, a phenomenon that a blackish color is observed depending on a viewing angle hardly occurs.

The ratio (A/B) is further preferably from 20 to 90, and particularly preferably from 40 to 80.

Measurement of Ratio (A/B) by Variable-Angle Photometer

Here, description will be given first of the incident angle and the light receiving angle. In the measurement by the variable-angle photometer in the exemplary embodiment, the incident angle is set to −45° since high measurement sensitivity is achieved with respect to images with glossiness in a wide range.

The light receiving angle is set to −30° and +30 since the highest measurement sensitivity is achieved in evaluation of images with glossy feeling and images with no glossy feeling.

Next, description will be given of a method of measuring the ratio (A/B).

In the exemplary embodiment, a "solid image" is formed first by the following method when the ratio (A/B) is measured. A developing machine DOCUCENTRE-III C7600 manufactured by Fuji Xerox Co. , Ltd. is filled with a sample developer, and a solid image with a toner application amount of 4.5 g/m$^2$ is formed on a recording sheet (OK TOP COAT sheets manufactured by Oji Paper Co. , Ltd.) at a fixing temperature of 190° C. and a fixing pressure of 4.0 kg/cm$^2$. The "solid image" means an image with 100% printing rate.

A stereoscopic variable-angle colorimeter GC5000L manufactured by Nippon Denshoku Industries Co., Ltd. is used as a varied-angle photometer to cause incident light at an incident angle of −45° with respect to the solid image to be incident on an image portion in the formed solid image, and the reflectance A at the light receiving angle of +30° and the reflectance B at the light receiving angle of −30° are measured. The reflectance A and the reflectance B are measured from light with wavelengths in a range from 400 nm to 700 nm at an interval of 20 nm, and average values of the reflectance at the respective wavelengths are obtained. The ratio (A/B) is calculated from these measurement results.

The brilliant toner according to the exemplary embodiment preferably satisfies the following requirements (a) and (b) from a viewpoint of satisfying the above ratio (A/B). That is, the following requirement (a) means that the toner particle of the brilliant toner has a flake shape. Specifically, the toner particles according to the first aspect, the second aspect, the fifth aspect, and the sixth aspect in the brilliant toner of the exemplary embodiment correspond to the toner particles that meet the following requirement (a).

(a) An average equivalent circle diameter D is greater than an average maximum thickness C of the toner particle.

(b) A rate of brilliant pigment particles with angles in a range from −30° to +30° between a longitudinal axis direction in sections of the toner particles and a longitudinal axis direction of the brilliant pigment in observation thereof in a thickness direction is equal to or greater than 60% of the entire brilliant pigment particles observed.

Figure 3:
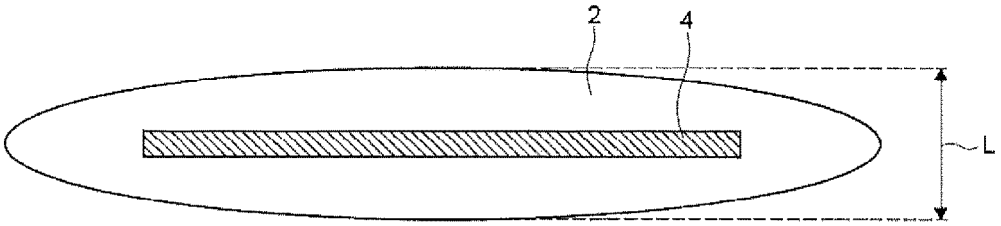
FIG. 3 is a sectional view schematically illustrating toner particles according to the exemplary embodiment.

Here, FIG. 3 is a sectional view schematically illustrating an exemplary toner particle that meets the above requirements (a) and (b)f. The schematic diagram in FIG. 3 is a sectional view of the toner particle in the thickness direction.

The toner particle 2 illustrated in FIG. 3 is a flake toner particle with a longer equivalent circle diameter than the thickness L and contains a flake (flaky) brilliant pigment particle 4.

It is considered that if the toner particle 2 has a flake shape in which the equivalent circle diameter is longer than the thickness L as illustrated in FIG. 3, then the flake surface side of the flake brilliant toner is aligned so as to face the surface of the recording medium in a fixation process for forming an image due to a pressure during the fixation. That is, it is considered that the flake surface side of the flake toner particle is aligned so as to face the surface of the recording medium on the recording medium to which the toner particle is finally transferred. It is also considered that the flake surface side of the flake toner particle is aligned so as to face the surface of the recording medium even in the fixation process for forming an image due to the pressure for the fixation.

Therefore, it is considered that a side of the maximum area surface of the brilliant pigment particle, which satisfies the above requirement (b) "angles are in a range from −30 to +30° between a longitudinal axis direction in sections of the toner particles and a longitudinal axis direction of the brilliant pigment particles", in the flake-shaped (flaky) brilliant pigment particles contained in the toner particles is aligned so as to face the surface of the recording medium. It is considered that the above range of ratio (A/B) is achieved since the rate of the brilliant pigment particles reflected in a scattered manner is prevented with respect to the incident light in a case of causing light to be incident on the thus formed image.

Hereinafter, detailed description will be given of the toner according to the exemplary embodiment.

The toner according to the exemplary embodiment includes toner particles. The toner according to the exemplary embodiment may include an external additive that is externally added to the toner particles, as needed.

Toner Particles

The toner particles contain brilliant pigment, binder resin, and a release agent. The release agent forms release agent domains that meet the conditions (1) to (4). The toner particles may contain other additives as needed.

Brilliant pigment

Examples of the brilliant pigment includes a pigment (brilliant pigment) that may apply glossy feeling such as metallic luster. Specific examples of the brilliant pigment include: metal powder such as aluminum (metal of Al alone), brass, bronze, nickel, stainless steel, or zinc; mica that covers titanium oxide, yellow iron oxide, or the like; an inorganic crystal substrate with a thin piece shape covered with barium sulfate, layer silicate, silicate of layer aluminum; single crystal plate titanium oxide; basic carbonate; bismuth acid oxychloride; natural guanine; thin-piece-shaped glass powder; and metal deposited thin-piece-shaped glass powder, and there is no particular limitation as long as the pigment exhibits brilliance.

Among the examples of the brilliant pigment, metal powder is preferably used, and particularly, aluminum is the most preferably used in terms of specular reflection intensity.

Although the shape of the brilliant pigment according to the exemplary embodiment is not particularly limited, flake shape (flaky) is preferably employed in terms of high brilliance in a fixed image.

Thus, description will be given of the flake shape brilliant pigment in the exemplary embodiment.

The average length of the flake brilliant pigment in the longitudinal axis direction is preferably from 1 μm to 30 μm, more preferably from 3 μm to 20 μm, and further preferably from 5 μm to 15 μm.

A ratio (aspect ratio) of the average length in the longitudinal axis direction on the assumption that the average length of the brilliant pigment in the thickness direction is 1 is preferably from 5 to 200, more preferably from 10 to 100, and further preferably from 30 to 70.

The respective average length and the aspect ratio of the brilliant pigment are measured by the following method. A scanning electron microscope (S-4800 manufactured by Hitachi High-Technologies Corporation) is used to take a photograph of the pigment particles at a magnification at which measurement may be performed (300 folds to 100, 000 folds), the length in the length in the longitudinal axis direction and the length in the thickness direction of each particle are measured in a state in which the obtained image of the pigment particles is displayed in a two-dimensional manner, and the average length in the longitudinal axis direction and the aspect ratio of the brilliant pigment are calculated.

The content of the brilliant pigment is preferably from 1 parts by weight to 50 parts by weight, and more preferably from 15 parts by weight to 25 parts by weight with respect to 100 parts by weight of the toner particles, for example.

Binder Resin

Examples of the binder resin include a vinyl resin including a homopolymer of monomer such as styrenes (such as styrene, parachlorostyrene, or α-methylstyrene), (meth) acrylic acid esters (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, or 2-ethylhexyl methacrylate), ethylenic unsaturated nitriles (such as acrylonitrile, or methacrylonitrile), vinyl ethers (such as vinyl methyl ether, or vinyl isobutyl ether), vinyl ketones (vinyl methyl ketone, vinyl ethyl ketone, or vinyl isopropenyl ketone), and olefins (such as ethylene, propylene, or butadiene) or a copolymer of two or more kinds of the monomers.

Examples of the binder resin also include a non-vinyl resin such as an epoxy resin, a polyester resin, a polyurethane resin, a polyamide resin, a cellulose resin, a polyether resin, or a modified rosin, a mixture of such a non-vinyl resin and the above-described vinyl resin, and graft polymer obtained by polymerizing vinyl monomer in the presence of any one of these resins.

One kind or two or more kinds of such binder resin may be used alone or in combination.

Polyester resin is preferably used as the binder resin.

Examples of polyester resin include known polyester resin.

Examples of polyester resin include condensation polymer of polyvalent carboxylic acid and polyvalent alcohol. A commercially available polyester resin or synthesized polyester resin may be used.

Examples of polyvalent carboxylic acid include aliphatic dicarboxylic acid (such as oxalic acid, malonic acid, maleic acid, fumaric acid, citraconic acid, itaconic acid, glutaconic acid, succinic acid, alkenylsuccinate, adipic acid, or sebacic acid), alicyclic dicarboxylic acid (such as cyclohexane dicarboxylic acid), aromatic dicarboxylic acid (such as terephthalic acid, isophthalic acid, phtalic acid, or naphthalenedicarboxylic acid), anyhydride thereof, or lower alkyl ester (containing from 1 to 5 carbon atoms, for example) thereof. Among the examples, aromatic dicarboxylic acid, for example, is preferably used as polyvalent carboxylic acid.

As polyvalent carboxylic acid, trivalent or higher carboxylic acid with a crosslinked structure or a branched structure may be used with dicarboxylic acid. Examples of trivalent or higher carboxylic acid include trimellitic acid, pyromellitic acid, anhydride thereof, or lower alkyl ester (containing from 1 to 5 carbon atoms, for example) thereof.

One kind or two or more kinds of polyvalent carboxylic acid may be used alone or in combination.

Examples of polyvalent alcohol include aliphatic diol (such as ethylene glycol, diethylene glycol, triethylene glycol, propylene glycol, butanediol, hexanediol, or neopentyl glycol), alicyclic diol (such as cyclohexanediol, cyclohexanedimethanol, hydrogenated bisphenol A), and aromatic diol (such as ethylene oxide adduct of bisphenol A or propylene oxide adduct of bisphenol A). Among the examples, aromatic diol, alicyclic diol are preferably used, and aromatic dial is more preferably used as polyvalent alcohol.

As polyvalent alcohol, trivalent or higher polyvalent alcohol with a crosslinked structure or a branched structure may be used with diol. Examples of trivalent or higher polyvalent alcohol include glycerine, trimethylol propane, and pentaerythritol.

One kind or two or more kinds of polyvalent alcohol may be used alone or in combination.

The glass transition temperature (Tg) of polyester resin is preferably from 50° C. to 80° C., and more preferably from 50° C. to 65° C.

The glass transition temperature is determined by a DSC curve obtained by a differential scanning calorimetry (DSC).

More specifically, the glass transition temperature is determined based on "Extrapolation glass transition onset temperature" described in how to determine glass transition temperature in JIS K 7121-1987 "Method of measuring plastic transition temperature".

The weight average molecular weight (Mw) of polyester resin is preferably from 5,000 to 1,000,000, and more preferably from 7,000 to 500,000.

The number average molecular weight (Mn) of polyester resin is preferably from 2,000 to 100,000.

The molecular weight distribution Mw/Mn of polyester resin is preferably from 1.5 to 100, and more preferably from 2 to 60.

The weight average molecular weight and the number average molecular weight are measured by gel permeation choromatography (GPC). The molecular weight measurement by the GPC is performed by using GPC.HLC-8120GPC manufactured by Tosoh Corporation as a measurement apparatus, a column TSKgel SUPERHM-M (15 cm) manufactured by Tosoh Corporation, and THF solvent. The weight average molecular weight and the number average molecular weight are calculated by using a molecular weight calibration curve created by a mono-dispersed polystyrene standard sample from the measurement result.

The polyester resin is obtained by a known preparing method. Specifically, the polyester resin is obtained by a method of setting a polymerization temperature to be from 180° C. to 230° C., for example, reducing a pressure in a reaction system as needed, and causing a reaction while removing water and alcohol that are generated during condensation.

In a case in which monomer of the raw materials are not dissolved or blended at the reaction temperature, a solvent with a high boiling temperature may be added as a solubilizer to promote the dissolution. In such a case, the polycondensation reaction is performed while distillating the solubilizer. In a case in which monomer with low compatibility is present, it is preferable to condense the monomer with low compatibility and acid or alcohol to be polycondensed with the monomer in advance and then cause polycondensation with main constituents.

The content of the binder resin is preferably from 40% by weight to 95% by weight, more preferably from 50% by weight to 90% by weight, and further preferably from 60% by weight to 85% by weight with respect to the entire toner particles, for example.

Release Agent

Examples of the release agent include hydrocarbon wax; natural wax such as carnauba wax, rice wax, or candelilla wax; synthesized, mineral, or petroleum wax such as montan wax or Fischer-Tropsch wax; and ester wax such as fatty acid ester or montanic acid ester. The release agent is not limited thereto.

Among these examples, the hydrocarbon wax is preferably used since the release agent may easily form the release agent domains that meet the conditions (1) to (4) in the toner particles.

The melting temperature of the release agent is preferably from 50° C. to 110° C., and more preferably from 60° C. to 100° C.

The melting temperature is obtained based on "Melting peak temperature" described in how to obtain a melting temperature in JIS K 7121-1987 "Method of measuring plastic transition temperature" from a DSC curve obtained by a differential scanning calorimetry (DSC).

Preferable examples of the brilliant toner according to the exemplary embodiment include a brilliant toner in which a melting temperature of the release agent is from 50° C. to 110° C., the toner particles includes a polyester resin having a glass transition temperature of 50° C. to 80° C., and a ratio (Tm/Tg) between a melting temperature (Tm) and a glass transition temperature (Tg) of the release agent is from 1.0 to 2.2.

The content of the release agent is preferably from 1% by weight to 20% by weight, and more preferably from 5% by weight to 15% by weight with respect to the entire toner particles, for example.

Other Additives

Examples of other additives include known additives such as a magnetic material, a charge-controlling agent, and inorganic powder. Such additives are contained in the toner particles as an internal additive.

Properties of Toner Particles

The toner particles may be toner particles with a monolayer structure or may be toner particles with a so-called core shell structure formed of a core (core particle) and a covering layer (shell layer) covering the core.

In the exemplary embodiment, the toner particles preferably have the following core shell structure.

Each toner particle with the core shell structure preferably includes a core (core particle) that contain a first binder resin and a. brilliant pigment, a first shell layer that covers the surface of the core particle and contains a second binder resin and a release agent, and a second shell layer that covers the surface of the first shell layer and contains a. third binder resin.

The above toner particle with the core shell structure (core particle/first shell layer/second shell layer) has a configuration in which the release agent is contained in the first shell layer, and it becomes easier for the release agent to form the release agent domains that meet the conditions (1) to (4) in the toner particles. Accordingly, lubricity (slipperiness) of the surface of the toner particles tends to be enhanced, and the occurrence of crack on the surface of the photoreceptor tends to be prevented.

According to the above toner particle with the core shell structure, exposure of the release agent from the surface of the toner particle is prevented since the second shell layer that covers the first shell layer is present. In contrast, the bleeding property of the release agent in fixation of the toner image is enhanced since the release agent is contained in the first shell layer. Accordingly, deterioration in a releasing property of the toner particle is prevented even if the content of the release agent with respect to the toner particle is reduced. Therefore, dispersibility of the brilliant pigment contained in the toner particle is relatively enhanced, and a color region of a secondary color is expanded.

A preparation method of the toner particles will be described later.

Average maximum thickness C and average equivalent circle diameter D of toner particles As described above in (a), the toner particles have a flake shape, and the average equivalent circle diameter D is preferably longer than the average maximum thickness C. It is more preferable that the ratio (C/D) of the average maximum thickness C and the average equivalent circle diameter D is within the range from 0.001 to 0.500, it is further preferable that the ratio is within the range from 0.010 to 0.200, and it is particularly preferable that the ratio is within the range from 0.050 to 0.100.

If the ratio (C/D) is equal to or greater than 0.001, strength of the toner is secured, breakage due to a stress during image formation is prevented, decrease in charge and thus occurring blushing due to exposure of the pigment are prevented. On the other hand, if the ratio is equal to or less than 0.500, excellent brilliance may be achieved.

The average maximum thickness C and the average equivalent circle diameter D are measured by the following method.

The toner particles are placed on a flake surface and are then dispersed without irregularity by applying vibration thereto. The average maximum thickness C and the average equivalent circle diameter D are calculated by using a color laser microscope "VK-9700" (manufactured by Keyence Corporation) to magnify 1,000 toner particles 1,000 times, measuring the maximum thickness C of the toner particles and the equivalent circle diameter D of the plane when viewed from the upper side, and obtaining arithmetic mean values thereof.

Angle between longitudinal axis direction in section of toner particle and longitudinal axis direction of brilliant pigment particle As described above in (b), in a case of observing a section of a toner particle in the thickness direction, a rate (number basis) of the brilliant pigment particles with angles in the range from −30° to +30° between the longitudinal axis direction in the sections of the toner particles and the longitudinal axis direction of the brilliant pigment particles is preferably equal to or greater than 60% with respect to the entire brilliant pigment particles observed. Furthermore, the rate is further preferably from 70% to 95%, and particularly preferably from 80% to 90%.

If the rate is equal to or greater than 60%, more excellent brilliance may be achieved.

Here, description will be given of a method of observing the section of the toner particle. A method of preparing the sample to be observed is the same as the "method of checking whether or not the release agent domains contained in the toner particle meet the conditions (1) to (4)".

The sample to be observed that is obtained by the method is used to observe sections of toner particles at a magnification of about 5,000 folds by a transmission electron microscope (TEM). The number of brilliant pigment particles with the angles in the range from −30° to +30° between the longitudinal axis direction in the sections of the toner particles and the longitudinal axis direction in the brilliant pigment particles from among 1,000 observed toner particles is counted, and the rate thereof is calculated by using image analysis software.

The "longitudinal axis direction in the sections of the toner particles" represents a direction orthogonal to the thickness direction of the toner particles with a longer average equivalent circle diameter D than the average maximum thickness C, and the "longitudinal axis direction of the brilliant pigment particles" represents a length direction of the brilliant pigment particles.

The volume average particle diameter of the toner particles is preferably from 1 μm to 30 μm, and more preferably from 3 μm to 20 μm.

The volume average particle diameter $D_{50v}$ of the toner particles is obtained by depicting the volume and the number from the smaller diameter side, respectively, in divided particle diameter ranges (channels) based on particle diameter distribution measured by a measurement apparatus such as MULTISIZER II (manufactured by Beckman Coulter). The particle diameter corresponding to accumulation of 16% is defined to have a volume $D_{16v}$ and a number $D_{16p}$, a particle diameter corresponding to accumulation of 50% is defined to have a volume $D_{50v}$ and a number $D_{50p}$, and a particle diameter corresponding to accumulation of 84% is defined to have a volume $D_{84v}$ and a number $D_{84p}$. The volume average particle diameter distribution index (GSDv) is calculated as $(D_{84v}/D_{16})^{1/2}$ by using the values.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

It is preferable that the surfaces of the inorganic particles as the external additive are treated with a hydrophobizing agent. The treatment with the hydrophobizing agent is performed by dipping the inorganic particles in a hydrophobizing agent, for example. Although the hydrophobizing agent is not particularly limited, examples thereof include a silane coupling agent, silicone oil, a titanate coupling agent, and an aluminum coupling agent. One kind or two or more kinds of the hydrophobizing agents may be used alone or in combination.

The amount of the hydrophobizing agent is typically from 1 part by weight to 10 parts by weight with respect to 100 parts by weight of the inorganic particles, for example.

Examples of the external additive also include resin particles (resin particles of polystyrene, polymethyl methacrylate (PMMA), melamine resin, or the like) and a cleaning aid (metal salt of higher fatty acid, representative examples of which include zinc stearate, or particles of fluorine high-molecular-weight material).

The amount of the external additive is preferably from 0.01% by weight to 5% by weight, and more preferably from 0.01% by weight to 2.0% by weight with respect to the amount of the toner particles, for example.

Preparation Method of Toner

Next, description will be given of a preparation method of the toner according to the exemplary embodiment.

The toner according to the exemplary embodiment is obtained by preparing the toner particles and then externally adding the external additive to the toner particles.

The toner particles may be prepared by any of a dry preparing method (such as a kneading and pulverizing method) and a wet preparing method (such as an aggregating and coalescing method, a suspension polymerization method, or a dissolution suspension method). The preparation method of the toner particles is not limited to these preparing methods, and a known preparing method is employed.

Among these methods, it is preferable to obtain the toner particles by the aggregating and coalescing method.

The toner particles according to the exemplary embodiment preferably have a core shell structure including the core (core particles) of the first binder resin and the brilliant pigment, the first shell layer that covers the surface of the core particle and includes the second binder resin and the release agent, and the second shell layer that covers the surface of the first shell layer and includes the third binder resin from the viewpoint that the release agent may easily form the release agent domains that meet the conditions (1) to (4) in the toner particles, as described above.

Hereinafter, an exemplary preparation method of the toner particles with the core shell structure will be described. The toner particles may be prepared by the following processes of the aggregating and coalescing method.

Specifically, it is preferable to prepare the toner particles by a process of preparing the respective dispersions (respective dispersions preparation process), a process of forming first aggregated particles by mixing a first resin particle dispersion in which the first resin particles as the first binder resin are dispersed with a brilliant pigment particle dispersion in which particles of the brilliant pigment (hereinafter, also referred to as "p brilliant pigment particles") are dispersed and aggregating the respective particles in the obtained dispersion (first aggregated particle formation process (also referred to as a core particle formation process)), a process of forming second aggregated particles by further mixing the first aggregated particle dispersion, the mixed dispersion in which the second resin particles as the second binder resin and particles of the release agent (hereinafter, also referred to as "release agent particles") are dispersed after obtaining the first aggregated particle dispersion in which the first aggregated particles are dispersed, and agglomerating the mixture such that the second binder rein and the release agent particles attach to the surfaces of the first aggregated particles (second aggregated particle formation process (also referred to as core particle/first shell layer formation process)), a process of forming third aggregated particles by further mixing the second aggregated particle dispersion with a third resin particle dispersion in which third resin particles as third binder resin are dispersed after obtaining the second aggregated particle dispersion in which the second aggregated particles are dispersed, and aggregating the mixture such that the third resin particles further attach to the surfaces of the second aggregated particles (third aggregated particle formation process (also referred to as a core particle/first shell layer/second shell layer formation process)), a process of forming toner particles by heating the third aggregated particle dispersion in which the third aggregated particles are dispersed and coalescing the third aggregated particles (coalescing process), and a process of cooling the mixture once after the third aggregated particles are coalesced and increasing the temperature again to the temperature at which the release agent is melted or a temperature that is equal to or greater than the melting temperature (temperature re-increasing process).

Hereinafter, detailed description will be given of the respective processes.

Respective Dispersions Preparation Process

First, the respective dispersions to be used by the aggregating and coalescing method are prepared. Specifically, the first resin particle dispersion in which the first resin particles as the binder resin are dispersed, the brilliant pigment particle dispersion in which the brilliant pigment particles are dispersed, the second resin particle dispersion in which the second resin particles as the binder resin are dispersed, the third resin particle dispersion in which the third resin particles as the binder resin are dispersed, and the release agent particle dispersion in which the release agent particles are dispersed are prepared.

The respective dispersions preparation process will be described, in which the first resin particles, the second resin particles, and the third resin particles will be referred to as "resin particles".

Here, the resin particle dispersion is prepared by dispersing the resin particles in a dispersion medium by a surfactant.

Examples of the dispersion medium used in the resin particle dispersion include a water medium.

Examples of the water medium include water such as distilled water or ion-exchanged water, and alcohols. One kind or two or more kinds of these water media may be used alone or in combination.

Examples of the surfactant include: an anionic surfactant such as sulfuric acid ester salt surfactant, a sulfonic acid salt surfactant, a phosphoric acid ester surfactant, or a soap surfactant; a cationic surfactant such as an amine salt-type surfactant or a quaternary ammonium salt-type surfactant; and a nonionic surfactant such as a polyethylene glycol surfactant, an alkylphenolethylene oxide adduct surfactant, or a polyvalent alcohol surfactant. Among these examples, the anionic surfactant and the cationic surfactant are exemplified. The nonionic surfactant may be used with the anionic surfactant or the cationic surfactant.

One kind or two or more kinds of the surfactants may be used alone or in combination.

Examples of a method of dispersing the resin particles in the dispersion medium in the resin particle dispersion include typical dispersion methods using a rotation shear-type homogenizer, a ball mill provided with media, a sand mill, or a dyno mill, for example. The resin particles may be dispersed in the resin particle dispersion by using a phase transition emulsification method, for example, depending on the type of the resin particles.

The phase transition emulsification method is a method of dispersing the resin in a particle state in a water medium by dissolving the resin to be dispersed in a hydrophobic organic solvent in which the resin is soluble, adding a base to an organic continuous phase (O phase), neutralizing the mixture, and pouring the water medium (W phase) to cause transition of the resin (so-called phase transition) from W/O to O/W and obtain non-continuous phase.

The volume average particle diameter of the resin particles dispersed in the resin particle dispersion is preferably from 0.01 μm to 1 μm, more preferably from 0.08 μm to 0.8 μm, and further preferably from 0.1 μm to 0.6 μm, for example.

The volume average particle diameter of the resin particles is measured by using particle diameter distribution obtained by measurement using a laser diffraction-type particle diameter distribution measurement apparatus (LA-700 manufactured by Horiba, Ltd., for example), subtracting cumulative distribution of volume from the small particle diameter side in divided particle diameter ranges (channels), and regarding a particle diameter corresponding to accumulation of 50% with respect to the entire parties as a volume average particle diameter D50v. The volume average particle diameters of particles in the other dispersions are also measured in the same manner.

The content of the resin particles contained in the resin particle dispersion is preferably from 5% by weight to 50% by weight, and more preferably from 10% by weight to 40% by weight, for example.

For preparing the brilliant pigment dispersion, a known dispersing method may be used, a typical dispersing unit such as a rotation shear-type homogenizer, a ball mill provided with media, a sand mill, a dyno mill, or an ultimizer may be employed, and there is no limitation. The brilliant pigment is dispersed in water along with an ionic surfactant or a polymer electrolyte such as polymeric acid or polymeric base. It is only necessary for the volume average particle diameter of the brilliant pigment dispersed to be equal to or less than 20 μm, the brilliant pigment with the volume average particle diameter within the range from 3 μm to 16 μm is preferably used since the brilliant pigment exhibits satisfactory dispersion in the toner particles without damaging the aggregating property.

The dispersion of the brilliant pigment covered with the binder resin may be prepared by dispersing, dissolving, and mixing the brilliant pigment and the binder resin and dispersing the mixture in water by phase transition emulsification or shear emulsification.

First Aggregated Particle Formation Process (Core Particle Formation Process)

Next, the first resin particle dispersion and the brilliant pigment particle dispersion are mixed.

Then, the first resin particles and the brilliant pigment particles are hetero-aggregated in the mixed dispersion, and the first aggregated particles (core particles) containing the first resin particles and the brilliant pigment particles are formed.

The first aggregated particles (core particles) are formed by setting pH of the mixture solution to be acidic while stirred, in many cases. It is possible to set the ratio (C/D) within the preferable range by the stirring condition. More specifically, it is possible to set the ratio (C/D) to be small by stirring the mixture at a high speed and heating the mixture in the stage of forming the first aggregated particles, and it is possible to set the ratio (C/D) to be large by stirring the mixture at a lower speed and heating the mixture at a lower temperature. In addition, pH is preferably within the range from 2 to 7, and it is effective to use an aggregating agent at this time.

As the aggregating agent, divalent or higher metal complex as well as a surfactant with opposite polarity to that of the surfactant used in the dispersant and inorganic metal salt is preferably used. In particular, the usage of the metal complex is particularly preferable since it is possible to reduce the amount of surfactant use and enhance a charging property.

As an inorganic metal salt, an aluminum salt and polymer thereof are particularly preferably used. As for the valence of the inorganic metal salt, a divalent inorganic metal salt is more suitable than a monovalent inorganic metal salt, a trivalent inorganic metal salt is more suitable than the divalent inorganic metal salt, and a tetravalent inorganic metal salt is more suitable than the trivalent inorganic metal salt, and in a case of the same valence, a polymerization-type inorganic metal salt polymer is more suitable in order to obtain narrower particle diameter distribution.

In the exemplary embodiment, it is preferable to use tetravalent inorganic metal salt polymer including aluminum in order to obtain narrow particle diameter distribution.

Second aggregated particle formation process (core particle/first shell layer formation process)

Next, a mixed dispersion in which the second resin particles and the release agent particles are dispersed is additionally added to the first aggregated particle dispersion after the first aggregated particle dispersion in which the first aggregated particles are dispersed is obtained.

The second resin particle dispersion is prepared in the same manner as the first resin particle dispersion. That is, in relation to the volume average particle diameter of the particles, the dispersion medium, the dispersing method, and the content of the particles in the first resin particle dispersion, the same is true for the second resin particles to be dispersed in the second resin particle dispersion.

For preparing the release agent dispersion, a release agent is dispersed along with an ionic surfactant and a polymer electrolyte such as polymeric acid or polymeric base in water, the resulting object is heated at a temperature of equal to or greater than a melting temperature of the release agent, and dispersion processing is performed by using a homogenizer or a pressure ejection-type dispersing machine that applies high shear force. By such processing, the release agent dispersion is obtained. In the dispersion processing, an inorganic compound such as aluminum polychloride may be added to the dispersion. Examples of a preferable inorganic compound include aluminum polychloride, aluminum sulfate, highly basic aluminum polychloride (BAC), aluminum hydroxychloride, and aluminum chloride. Among these examples, aluminum polychloride, aluminum sulfate, and the like are preferably used.

By the dispersion processing, a release agent dispersion containing release agent particles with a volume average particle diameter of equal to or less than 1 μm is obtained. The volume average particle diameter of the release agent particles is more preferably from 100 nm to 500 nm.

If the volume average particle diameter is equal to or greater than 100 nm, the release agent component is easily taken into the toner in general, which is affected by properties of the binder resin used. If the volume average particle diameter is equal to or less than 500 nm, a satisfactory dispersing state of the release agent in the toner is achieved.

Then, the second resin particles and the release agent particles are aggregated on the surfaces of the first aggregated particles in the dispersion in which the first aggregated particles, the second resin particles, and the release agent particles are dispersed. Specifically, the mixed dispersion in which the second resin particle and the release agent particles are dispersed is added to the first aggregated particle dispersion when the first aggregated particles reach the targeted particle diameter in the first aggregated particle formation process, and the dispersion is heated at a temperature that is equal to or less than the glass transition temperature of the second resin particles. Thus, the second aggregated particles (core particles/first shell layer) in which the second resin particles and the release agent particles are aggregated so as to attach to the surfaces of the first aggregated particles are obtained.

The mixed dispersion may be a dispersion in which the respective particles are aggregated. The respective particles in the mixed dispersion may be aggregated in the same manner as in the first aggregated particle formation process.

Here, the weight ratio (second resin particles/release agent particles) between the second resin particles and the release agent particles in the mixed dispersion, which is used in forming the first shell layer, in which the second resin particles and the release agent particles are dispersed is preferably set to be from 50/50 to 95/5 (preferably from 60/40 to 90/10), for example, from the viewpoint of easily controlling the size, the shape, and the arrangement structure of the specific release agent domains that meet the conditions (1) to (4).

The content of the second resin particles with respect to the first aggregated particles is preferably from 20% by weight to 70% by weight, and more preferably from 30% by weight to 60% by weight, for example, from the viewpoint of easily controlling the size, the shape, and the arrangement structure of the specific release agent domains that meet the conditions (1) to (4).

Third Aggregated Particle Formation Process (Core Particle/First Shell Layer/Second Shell Layer Formation Process)

Next, the third resin particle dispersion in which the third resin particles as binder resin are dispersed is further added to the second aggregated particle dispersion after obtaining the second aggregated particle dispersion in which the second aggregated particles are dispersed.

The third resin particle dispersion is prepared in the same manner as the first resin particle dispersion. That is, as for the volume average particle diameter of the particles, the dispersion medium, the dispersing method, and the content of the particles in the first resin particle dispersion, the same is true for the third resin dispersed in the third resin particle dispersion.

The third resin particles are then aggregated on the surface of the second aggregated particles in the dispersion in which the second aggregated particles and the third resin particles are dispersed. Specifically, the third resin particle dispersion is added to the second aggregated particle dispersion when the second aggregated particles reach the targeted particle diameter in the second aggregated particle formation process, for example, and the dispersion is heated at a temperature that is equal to or less than the glass transition temperature of the third resin particles.

Then, advancing of the aggregation is stopped by setting pH of the dispersion to be within the range from about 6.5 to about 8.5, for example.

Thus, the third aggregated particles (core particle/first shell layer/second shell layer) in which the third resin particles are aggregated so as to attach to the surfaces of the second aggregated particles.

Here, the content of the third resin particles with respect to the first aggregated particles is preferably from 40% by weight to 100% by weight, and more preferably from 50% by weight to 80% by weight, for example, from the viewpoint of easily controlling the size, the shape, and the arrangement structure of the specific release agent domains that meet the conditions (1) to (4).

Coalescing Process

Next, the third aggregated particles are coalesced (also simply referred to as coalescence) by heating the third aggregated particle dispersion in which the third aggregated particles are dispersed at a temperature that is equal to or greater than the glass transition temperature of the first, second, and the third resin particles (such as a temperature that is equal to or greater than the glass transition temperature of the first, second, and third resin particles by 10° C. to 30° C.), for example.

Temperature Re-Increasing Process

Next, the third aggregated particle dispersion in which the third aggregated particles are dispersed is cooled. Thereafter, the temperature of the third aggregated particle dispersion is increased (heated) again at the temperature increasing speed from 0.01° C./minute to 0.5° C./minute (preferably from 0.01° C./minute to 0.1° C./minute) up to the melting temperature of the release agent or the temperature that is equal to or greater than the melting temperature.

The release agent domains contained in the first shell layer of the third aggregated particle grows due to the heating by adjusting the temperature re-increasing conditions (such as the temperature increasing speed and the temperature) of the third aggregated particle dispersion. Thus, it becomes easier for the release agent domains to meet the conditions (1) to (4).

More specifically, the release agent domains slowly grow in the first shell layer by heating the release agent particles included in the first shell layer in a state of being interposed between the first resin particle include in the core particle and the third resin particle included in the second shell layer. In the process of the growth, the release agent domains are considered to grow so as to extend along the outer circumferential surface of the first shell layer. It is considered that the growth directions of the release agent domains are controlled and it becomes easier for the release agent domains to meet the conditions (1) to (4) as a result.

By the processes, the toner particles in which the release agent domains meet the conditions (1) to (4) are obtained. This appears to cause the lubricity (slipperiness) of the surfaces of the toner particles to be enhanced and friction between the photoreceptor and the transfer member in transferring a toner image to be prevented.

Therefore, according to the brilliant toner including the toner particles with the core shell structure, occurrence of crack on the surface of the photoreceptor is prevented and gloss unevenness in the fixed image is prevented even if the harder brilliant pigment than ordinary pigments is included.

Since the release agent and the brilliant pigment in the toner particles with the core shell structure are hardly exposed from the surfaces of the toner particles, the toner particles have a preferable configuration in terms of a chargeability and a developing property.

Although the release agent is included only in the first shell layer in the exemplary embodiment, the core particle may contain the release agent. In the process of preparing the toner particles, the aggregating agent may be added before additionally adding the mixed dispersion or the like, or pH may be adjusted.

Here, the toner particles in a dried state after performing a known cleaning process, a solid-liquid separation process, and a drying process on the toner particles formed in the solution are obtained after the completion of the coalescing process and the temperature re-increasing process.

In the cleaning process, it is preferable to sufficiently perform replacement cleaning by ion-exchanged water in terms of chargeability. In the solid-liquid separation process, it is preferable to perform suction filtration, pressurizing filtration, or the like in terms of productivity though not particularly limited. In the drying process, it is preferable to perform freeze drying, flash drying, fluidized drying, or vibration-type fluidized drying in terms of productivity though the method is not particularly limited.

In addition, the third aggregated particle formation process may not be performed. That is, the toner particles according to the exemplary embodiment may have the core shell structure including the core (core particle) and the first shell layer. In such a case, the toner particles may be obtained by the processes except for the third aggregated particle formation process.

Then, the toner according to the exemplary embodiment is prepared by adding an external additive to the obtained toner particles in the dried state and mixing the external additive and the toner particles, for example. The mixing is preferably performed by a V blender, a Henschel mixer, a Loedige mixer, or the like. Furthermore, coarse particles of the toner may be removed by using a vibration classifier, a wind classifier, or the like as needed.

Electrostatic Charge Image Developer

The electrostatic charge image developer according to the exemplary embodiment contains at least the toner according to the exemplary embodiment.

The electrostatic charge image developer may be a one-component developer that contains only the toner according to the exemplary embodiment or may be a two-component developer in which the toner is mixed with a carrier.

The carrier is not particularly limited, and known carriers are exemplified. Examples of the carrier include a covered carrier in which the surfaces of cores made of magnetic particles are covered with covering resin; a magnetic particles dispersed-type carrier in which magnetic particles is dispersed and blended in matrix resin; and resin impregnation-type carrier in which resin is impregnated in porous magnetic particles.

The magnetic particle dispersed-type carrier and the resin impregnation-type carrier may be carrier in which constituent particles of the carriers form cores and the surfaces thereof are covered with the covering resin.

Examples of the magnetic particles include magnetic metal such as iron, nickel, or cobalt, and magnetic oxide such as ferrite and magnetite.

Examples of the covering resin and the matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid ester copolymer, or straight silicone resin or modified substances thereof that contain a organosiloxane bond, fluorine resin, polyester, polycarbonate, phenol resin, and epoxy resin.

The covering resin and the matrix resin may contain another additive such as conductive particles.

Examples of the conductive particles include: metal such as gold, silver, or copper; and particles of carbon black, titanium oxide, zinc oxide, tin oxide, barium sulfate, aluminum borate, potassium titanate, or the like.

Here, for covering the surfaces of the cores with the covering resin, a covering method using a solution for forming a covering layer that is obtained by dissolving the covering resin, and if necessary, various additives in an appropriate solvent is exemplified. The solvent is not particularly limited and may be selected in consideration of the covering resin used, application aptitudes, and the like.

Specific examples of the resin covering method include a dipping method of dipping the cores in the solution for forming the covering layer, a spray method of spraying the solution for forming the covering layer to the surfaces of the cores, a fluidized bed method of spraying the solution for forming the covering layer in a state in which the cores are made to float by air flow, and a kneader coater method of mixing the cores of the carrier and the solution for forming the covering layer in a kneader coater and then removing a solvent.

A mixing ratio (weight ratio) between the toner and the carrier in the two-component developer is preferably from toner :carrier=1:100 to 30:100, and more preferably from 3:100 to 20:100.

Image Forming Apparatus/Image Forming Method

Description will be given of an image forming apparatus and an image forming method according to the exemplary embodiment.

The image forming apparatus according to the exemplary embodiment includes an image holding member, a charging unit that charges a surface of the image holding member, an electrostatic charge image forming unit that forms an electrostatic charge image on the charged surface of the image holding member, a developing unit that accommodates an electrostatic charge image developer and develops the electrostatic charge image formed on the surface of the image holding member as a toner image by the electrostatic charge image developer, a transfer unit that transfers the toner image formed on the surface of the image holding member to a surface of a recording medium, and a fixing unit that fixes the toner image transferred to the surface of the recording medium. The electrostatic charge image developer according to the exemplary embodiment is applied as the electrostatic charge image developer.

The image forming apparatus according to the exemplary embodiment performs the image forming method (the image forming method according to the exemplary embodiment) including a charging process of charging the surface of the image holding member, an electrostatic charge image formation process of forming the electrostatic charge image on the charged surface of the image holding member, a developing process of developing the electrostatic charge image formed on the surface of the image holding member as the toner image by the electrostatic charge image developer according to the exemplary embodiment, a transfer process of transferring the toner image formed on the surface of the image holding member to the surface of the recording medium, and a fixing process of fixing the toner image transferred to the surface of the recording medium.

As the image forming apparatus according to the exemplary embodiment, a known image forming apparatus such as: a direct transfer-type apparatus that directly transfers the toner image formed on the surface of the image holding member to the recording medium; an intermediate transfer-type apparatus that primarily transfers the toner image formed on the surface of the image holding member to a surface of an intermediate transfer member and secondarily transfers the toner image transferred to the surface of the intermediate transfer member to the surface of the recording image; an apparatus provided with a cleaning unit that cleans the surface of the image holding member before the charging and after the transferring of the toner image; or an apparatus provided with a charge eliminating unit that eliminates the charge by irradiating the surface of the image holding member with charge eliminating light before the charging and after the transferring of the toner image is applied.

In a case of the intermediate transfer-type apparatus, a structure including an intermediate transfer member with a surface to which the toner image is transferred, a primary transfer unit that primarily transfers the toner image formed on the surface of the image holding member to the surface of the intermediate transfer member, and a secondary transfer unit that secondarily transfers the toner image transferred to the surface of the intermediate transfer member to the surface of the recording medium, for example, is applied.

In the image forming apparatus according to the exemplary embodiment, a portion including the developing unit, for example, may have a cartridge structure (process cartridge) that is detachable from the image forming apparatus. As the process cartridge, a process cartridge that accommodates the electrostatic charge image developer according to the exemplary embodiment and is provided with the developing unit is preferably used.

Hereinafter, description will be given of an example of the image forming apparatus according to the exemplary embodiment. However, the image forming apparatus is not limited thereto. Main components illustrated in the drawings will be described, and descriptions of the other components will be omitted.

Figure 4:
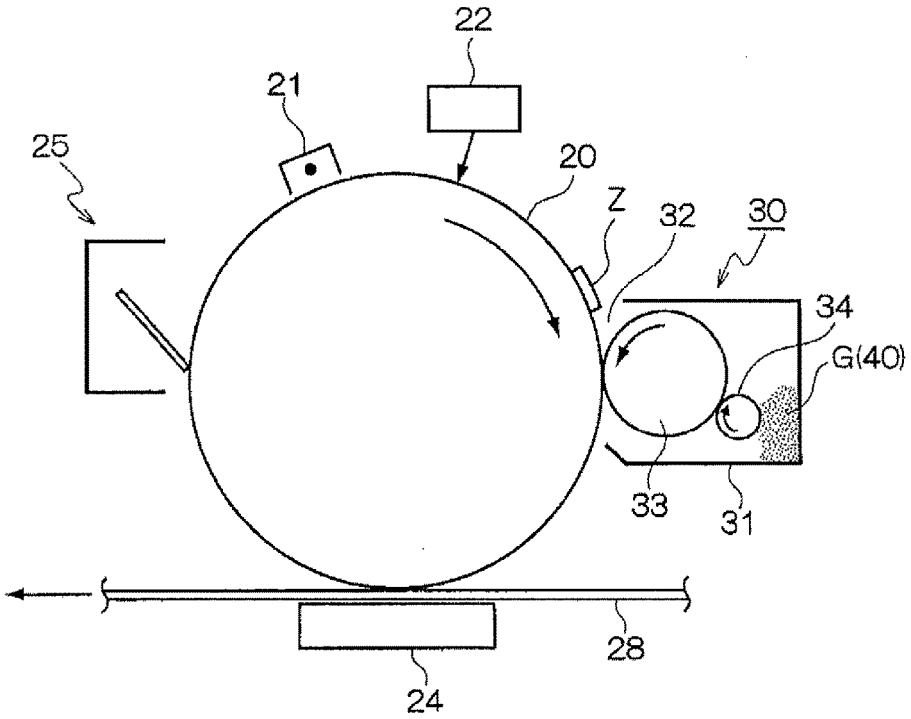
FIG. 4 is a configuration diagram schematically illustrating an image forming apparatus according to the exemplary embodiment.

FIG. 4 is a configuration diagram schematically illustrating an exemplary image forming apparatus that includes a developing device according to the exemplary embodiment to which the electrostatic charge image developer according to the exemplary embodiment is applied.

In the drawing, the image forming apparatus according to the exemplary embodiment includes a photoreceptor 20 as the image holding member that rotates in a predetermined direction. In the periphery of the photoreceptor 20, a charging device 21 (an example of the charging unit) that charges the photoreceptor 20 (an example of the image holding member), an exposure device 22 (an example of the electrostatic charge image forming unit), for example, as the electrostatic charge image forming device that forms an electrostatic charge image Z on the photoreceptor 20, a developing device 30 (an example of the developing unit) that develops the electrostatic charge image Z formed on the photoreceptor 20 as a visible image, a transfer device 24 (an example of the transfer unit) that transfers the toner image visualized on the photoreceptor 20 to a recording sheet 28 as the recording medium, and a cleaning device 25 (an example of the cleaning unit) that cleans toner remaining on the photoreceptor 20 are disposed in order.

In the exemplary embodiment, the developing device 30 includes a developing container 31 that accommodates a developer G containing a toner 40 as illustrated in FIG. 4. A developing opening 32 opens in the developing container 31 so as to face the photoreceptor 20. A developing roller (developing electrode) 33 as a toner holding member is disposed so as to face the developing opening 32. By applying a predetermined developing bias to the developing roller 33, a developing electric field is formed in a region (developing region) interposed between the photoreceptor 20 and the developing roller 33. Furthermore, a charge injection roller (injection electrode) 34 as a charge injecting member is provided in the developing container 31 so as to face the developing roller 33. In particular, the charge injection roller 34 also serves as a toner supply roller for supplying the toner 40 to the developing roller 33 in the exemplary embodiment.

Here, a rotation direction of the charge injection. roller 34 may be selected. However, the charge injection roller 34 preferably rotates in the same direction at the portion facing the developing roller 33 with a difference in the peripheral speeds (1.5 times or greater, for example), interpose the toner 40 in the region between the charge injection roller 34 and the developing roller 33, and injects the charge while scraping, in consideration of a toner supply property and a charge injection property.

Next, description will be given of operations of the image forming apparatus according to the exemplary embodiment.

If an image creating process is started, the charging device 21 charges the surface of the photoreceptor 20 first, the exposure device 22 writes the electrostatic charge image Z on the charged photoreceptor 20, and the developing device 30 develops the electrostatic charge image Z as a toner image that is a visible image. Thereafter, the toner image on the photoreceptor 20 is transported to the transfer portion, and the transfer device 24 electrostatically transfers the toner image on the photoreceptor 20 to the recording sheet 28 as the recording medium. The cleaning device 25 cleans the toner remaining on the photoreceptor 20. Thereafter, the fixing device (an example of the fixing unit) fixes the toner image on the recording sheet 28, and an image is obtained.

Process Cartridge/Toner Cartridge

Description will be given of the process cartridge according to the exemplary embodiment.

The process cartridge according to the exemplary embodiment is a process cartridge that includes a developing unit accommodating the electrostatic charge image developer according to the exemplary embodiment and develops the electrostatic charge image formed on the surface of the image holding member as a toner image by the electrostatic charge image developer and that is detachable from the image forming apparatus.

The process cartridge according to the exemplary embodiment is not limited to the configuration and may have a configuration that includes a developing device, and if necessary, at least one selected from other units such as an image holding member, a charging unit, an electrostatic charge image forming unit, and a transfer unit.

Although an example of the process cartridge according to the exemplary embodiment will be described below, the process cartridge is not limited thereto. In addition, main components illustrated in the drawings will be described, and descriptions of the other components will be omitted.

Figure 5:
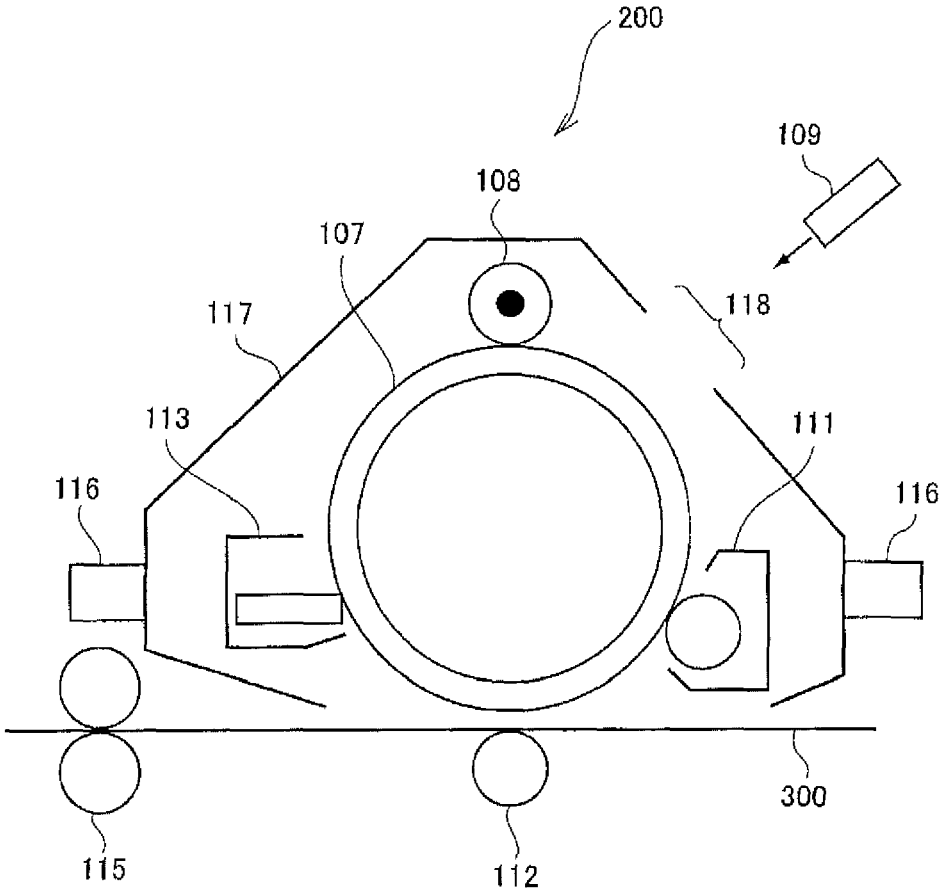
FIG. 5 is a configuration diagram schematically illustrating an exemplary process cartridge according to the exemplary embodiment.

FIG. 5 is a configuration diagram schematically illustrating the process cartridge according to the exemplary embodiment.

The process cartridge 200 illustrated in FIG. 5 integrally combines and holds a photoreceptor 107 (an example of the image holding member), a charging roller 108 (an example of the charging unit) provided in the periphery of the photoreceptor 107, a developing device 111 (an example of the developing unit), and a photoreceptor cleaning device 113 (an example of the cleaning unit) in a housing 117 provided with an attachment rail 116 and an opening 118 for exposure, for example, and is provide as a cartridge.

In FIG. 5, 109 represents an exposure device (an example of the electrostatic charge image forming unit), 112 represents a transfer device (an example of the transfer unit), 115 represents a fixing device (an example of the fixing unit), and 300 represents a. recording sheet (an example of the recording medium).

Next, description will be given of a toner cartridge according to the exemplary embodiment. The toner cartridge according to the exemplary embodiment may accommodate the brilliant toner according to the exemplary embodiment and may be detachable from the image forming apparatus. It is only necessary for the toner cartridge according to the exemplary embodiment to accommodate at least the toner, and the developer, for example, may be accommodated therein depending on a mechanism of the image forming apparatus. The toner cartridge may have a container which contains the brilliant toner according to the exemplary embodiment.

The image forming apparatus illustrated in FIG. 4 is an image forming apparatus with a configuration in which the toner cartridge (not shown) may be freely detachable from, and the developing device 30 is connected to the toner cartridge with a toner supply tube which is not shown in the drawing. In a case in which the amount of toner accommodated in the toner cartridge becomes small, the toner cartridge maybe replaced.

EXAMPLES

Although more specific description will be given below of the exemplary embodiment with reference to examples and comparative examples, the exemplary embodiment of the invention is not limited to the following examples. In addition, all the descriptions of "parts" and "%" are on a weight basis unless otherwise particularly stated.

Synthesis of Binder Resin

Ethylene oxide 2 mol adduct of bisphenol A: 216 parts

Ethylene glycol: 38 parts

Terephthalic acid: 200parts

Tetrabutoxy titanate (catalyst): 0.037 parts

The above components are put into a heated and dried two-necked flask, the temperature of the mixture is increased while an inert atmosphere is maintained by introducing nitrogen gas into the container and the mixture is stirred, co-condensation polymerization reaction is performed at 160° C. for 7 hours, and the temperature is then increased to 220° C. and maintained for 4 hours while the pressure is slowly reduced to 10 Torr. The pressure is released to the ordinary pressure once, 9 parts of anhydrous trimellitic anhydride is added thereto, the pressure is slowly reduced again to 10 Torr, and the mixture is then maintained at 220° C. for 1 hour, and a binder resin is thus synthesized.

Preparation of Resin Particle Dispersion

Binder resin: 160 parts

Ethyl acetate: 233 parts

Aqueous solution of sodium hydroxide (0.3N): 0.1 parts

The above components are put into a 1,000 ml separable flask, are heated at 70°, and stirred by a three one motor (manufactured by Shinto Scientific Co., Ltd.) to thereby prepare a resin mixture solution. 373 parts of ion-exchanged water is slowly added thereto, the mixture is subjected to phase inversion emulsification, and the solvent is removed therefrom, thereby obtaining a resin particle dispersion (solid component concentration: 30%).

Preparation of Release Agent Dispersion (P1)

Paraffin wax HNP0190 (melting temperature: 85° C., manufactured by Nippon Seiro Co., Ltd.): 180 parts Anionic surfactant (NEOGEN R manufactured by DSK Co., Ltd.): 4.5 parts Ion-exchanged water: 410 parts The above components are heated at 110° C., are dispersed by using a homogenizer (ULTRA-TURRAX T50 manufactured by IKA), and are subjected to dispersion processing by using a Manton Gaulin homogenizer (Manton Gaulin Manufacturing Co., Inc.), release agent particles having a volume average particle diameter of 0.24 μm are dispersed, concentration is adjusted by ion-exchanged water, and thus, a release agent dispersion (P1) in which the concentration of release agent particle solid component is 30.0% is prepared.

Preparation of Release Agent Dispersion (P2)

A release agent dispersion (P2) in which the solid component concentration of the release agent particles is 30.0% is prepared by performing the same preparation as that of the release agent dispersion (P1) except that microcrystalline wax HIMIC1090 (melting temperature: 82° C., manufactured by Nippon Seiro Co. , Ltd.) is used instead of the paraffin wax HNP0190 used in the preparation of the release agent dispersion (P1).

Preparation of Release Agent Dispersion (P3)

A release agent dispersion (P3) in which the solid component concentration of the release agent particles is 30.0% is prepared by performing the same preparation as that of the release agent dispersion (P1) except that Fischer-Tropsch wax FNP0090 (melting temperature: 90° C., manufactured by Nippon Seiro Co., Ltd.) is used instead of the paraffin wax HNP0190 used in the preparation of the release agent dispersion (P1).

Preparation of Release Agent Dispersion (P4)

A release agent dispersion (P4) in which the solid component concentration of the release agent particles is 30.0% is prepared by performing the same preparation as that of the release agent dispersion (P1) except that polyethylene wax POLYWAX725 (melting temperature: 104° C., manufactured by Baker Petrolite LLC.) is used instead of the paraffin wax HNP0190 used in the preparation of the release agent dispersion (P1).

Preparation of Brilliant Pigment Particle Dispersion (1)

Aluminum pigment (2173 EA manufactured by Showa Aluminum Corporation) 100 parts

Anionic surfactant (NEOGEN R manufactured by DSK Co., Ltd.): 1.5 parts

Ion-exchanged water: 900 parts

After removing a solvent from a paste of flake-shaped aluminum pigment, the above components are mixed and are dispersed for 1 hour by using an emulsification dispersing machine CAVITRON (CR1010 manufactured by Pacific Machinery & Engineering Co., Ltd.), and thus, a brilliant pigment particle dispersion (1) (solid component concentration: 10%) containing the flake-shaped brilliant pigment particles (aluminum pigment) dispersed therein is prepared.

Preparation of brilliant pigment particle dispersion (2)

Aluminum powder (019-18881: −45 μm manufactured by Wako Pure Chemical Industries, Ltd.): 100 parts Anionic surfactant (NEOGEN R manufactured by DSK Co., Ltd.): 1.5 parts Ion-exchanged water: 900 parts Spherical aluminum powder and the above components are mixed and are dispersed for 1 hour by using an emulsification dispersing machine CAVITRON (CR1010 manufactured by Pacific Machinery & Engineering Co., Ltd.), and thus, a brilliant pigment particle dispersion (2) (solid component concentration: 10%) containing the spherical brilliant pigment particles (aluminum pigment) dispersed therein is prepared.

Example 1

Preparation of Brilliant Toner

Resin particle dispersion: 193 parts

Brilliant pigment particle dispersion 1:300 parts

Nonionic surfactant (IGEPAL CA 897): 1.50

The above raw materials are place in a 2L cylindrical stainless steel container and are dispersed and mixed for 10 minutes while shear force is applied at 4,000 rpm by a homogenizer (ULTRA-TURRAX T50 manufactured by IRA). Then, 2.00 parts of 10% nitric acid solution of aluminum polychloride as an aggregating agent is slowly dropped thereto, the mixture is dispersed and mixed for 15 minutes by setting the rotational speed of the homogenizer to 5,000 rpm, and thus, a raw material dispersion is obtained.

Thereafter, the raw material dispersion is moved to a polymerization tank provided with a stirrer using two-paddle stirring blades and a thermometer, heating by a mantle heater is started while setting the stirring rotation speed to 810 rpm, and growth of the aggregated particles is promoted at 54° C. At this time, pH of the raw material dispersion is controlled within a range from 2.2 to 3.5 by 0.3N of nitric acid and 1N of sodium hydroxide solution. The raw material dispersion is maintained in the pH range for 2 hours, and aggregated particles are formed (process for forming core particles). At this time, the volume average particle diameter of the aggregated particles measured by using a MULTISIZER II (aperture diameter: 50 μm, manufactured by Beckman Coulter) is 9.5 μm.

Next, 133 parts of the resin particle dispersion and 53 parts of the release agent dispersion (P1) are additionally added, and 30 minutes later, 187 parts of the resin particle dispersion is further additionally added. Thus, the release agent and the resin particles are made to attach to the surfaces of the aggregated particles (core particle/first shell layer formation process), and the resin particles are further made to attach to the surfaces to which the release agent and the resin particles have been made to attach (core particle/first shell layer/second shell layer formation process). Next, the temperature is increased to 56° C., and the aggregated particles are adjusted while checking the size and the configuration of the particles by an optical microscope and a MULTISIZER II (aperture diameter: 50 μm manufactured by Beckman Coulter). Thereafter, pH is increased to 8.0, and the temperature is then increased to 90° C. for coalescing the aggregated particles. After checking by an optical microscope that the aggregated particles have been coalesced (coalescing process), pH is lowered to 6.0 while the temperature is maintained at 90° C., the heating is stopped 1 hour later, and the particles are cooled to 30° C. at a temperature lowering speed of 1.0° C./minute. Thereafter, the temperature is increased again at 0.05° C./minute to 87° C. at which the release agent is melted (temperature re-increasing process) and is maintained for 1 hours, and the particles are cooled at a speed of 2° C./minute to 30° C. Thereafter, the particles are classified with a mesh of 20 μm, are repeatedly washed with water, and dried by a vacuum drier, and toner particles are thus obtained. The volume average particle diameter of the obtained toner particles is 11.9 μm.

1.5 parts of hydrophobic silica (RY50 manufactured by Nippon Aerosil Co. , Ltd.) and 1.0 part of hydrophobic titanium oxide (T805 manufactured by Nippon Aerosil Co., Ltd.,) are mixed and blended with 100 parts of the obtained toner particles at 10,000 rpm for 30 seconds by using a sample mill. Thereafter, the mixture is classified with a vibration classifier with a mesh of 45 μm, and a brilliant toner in Example 1 is obtained. At this time, the volume average particle diameter of the aggregated particles measured by using a MULTISIZER II (aperture diameter: 50 μm manufactured by Beckman Coulter) is 10.4 μn.

Preparation of Carrier

Ferrite particles (volume average particle diameter: 35 μm): 100 parts

Toluene: 14 parts

Perfluoro acrylate copolymer (critical surface tension: 24 dyn/cm) 1.6 parts

Carbon black: 0.12 parts (product name: VXC-72 manufactured by Cabot Corporation, volume resistivity: equal to or less than 100 Ωcm)

Crosslinked melamine resin particles (average particle diameter: 0.3 μm, toluene insoluble portion): 0.3 parts First, carbon black is diluted in toluene, the mixture is added to the perfluoro acrylate copolymer and is dispersed in a sand mill. Then, the above respective components except the ferrite particles are dispersed for 10 minutes by a stirrer, and a solution for forming a covering layer is obtained. Then, the solution for forming the covering layer and the ferrite particles are put into a vacuum degassing-type kneader, and the mixture is stirred at 60° C. for 30 minutes. Then, the pressure is reduced, toluene is evaporated, a resin covering layer is formed, and thus, a carrier is obtained.

Preparation of Developer 8 parts of the brilliant toner in Example 1 and 100 parts of the carrier are put into af 2-liter V blender, are mixed for 20 minutes, and are then classified with a mesh of 212 μm, and thus, a developer in Example 1 is prepared.

Examples 2 to 15 and Comparative Examples 1 to 5

Brilliant toners in Examples 2 to 15 and Comparative Examples 1 to 5 are prepared in the same manner as in the preparation of the brilliant toner in Example 1 except that the type and the amount of the brilliant pigment particle dispersion used in the core particle formation process, the amount of the resin particle dispersion, the amount of the resin particle dispersion additionally added in the core particle/first shell layer formation process, the type and the amount of the release agent dispersion, the amount of the resin particle dispersion additionally added in the core particle/first shell layer/second shell layer formation process, and the temperature re-increasing conditions (the temperature increasing speed and the temperature) in the temperature re-increasing process in the preparation method of the brilliant toner described in Example 1 are changed based on Tables 1 and 2.

Here, the temperature re-increasing conditions mean the temperature re-increasing speed and the temperature employed when the temperature of the aggregated particles is increased again to the temperature at which the release agent is melted or a temperature that is equal to or greater than the melting temperature thereof after coalescing the aggregated particles and then cooling the aggregated particles once.

However, with respect to Comparative Examples 2 and 5, the brilliant toners are prepared by further changing the following requirements in addition to the requirements shown in Tables 1 and 2 in the preparation method of the brilliant toner described in Example 1.

In Comparative Example 2, the temperature re-increasing process after the coalescing process is not performed in the preparation method of the brilliant toner described in Example 1.

In Comparative Example 5, the core particles are formed by adding the release agent dispersion (P1) along with the resin particle dispersion, the brilliant pigment particle dispersion (1), and the nonionic surfactant in the core particle formation process without adding the release agent dispersion (P1) in the core particle/first shell layer formation process in the preparation method of the brilliant toner described in Example 1. Thus, the release agent is dispersed in the core particles.

Thereafter, developers in Examples 2 to 15 and Comparative Examples 1 to 5 are prepared in the same manner as the developer in Example 1.

Evaluation

Properties of Toner Particles

The toner particles obtained in the process of Example 1 are used to measure the length of each release agent domain in the longitudinal axis direction (condition (1)), the ratio (the length in the longitudinal axis direction/the length in the short axis direction) (condition (2)), the angle θ of the release agent domain (condition (3)), the ratio (distance A/equivalent circle diameter) (condition (4)), and the rate (% by number) of the toner particles with respect to the entire toner particles by the methods as described above. The measurement is performed in Examples 2 to 15 and Comparative Examples 1 to 5 in the same manner as the methods in Example 1. The results will be shown in Tables 3 and 4.

SEM Photograph of Toner Particle

Figure 6:
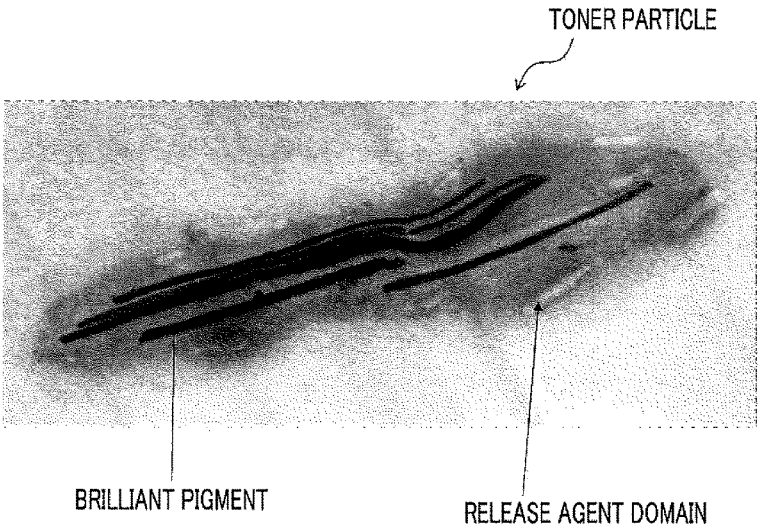
FIG. 6 is a diagram illustrating an SEM photograph of a section of a toner particle in Example 1.

A section of a toner particle obtained in the process of Example 1 is observed by a scanning electron microscope (SEM). FIG. 6 is an SEM photograph of the section of the toner particle in Example 1.

The toner particle in Example 1 includes multiple flake brilliant pigment particles and multiple flake release agent domains, and presence of the release agent domains on the surface side of the toner particle is observed.

Evaluation of Crack on Surface of Photoreceptor

The brilliant toners and the developers obtained in the respective examples are used to evaluate crack on the surface of the photoreceptor.

A developing machine COLOR 1000 PRESS manufactured by Fuji Xerox Co., Ltd. is filled with the developer in an environment at a temperature of 25° C. and a moisture of 70%, and a toner cartridge is filled with the brilliant toner. Subsequently, solid images with the brilliant toner applied amount of 4.0 g/m$^2$ are continuously printed on 3,000 coated sheets (OK TOP COAT sheets, surface roughness Rz=1.98 μm, manufactured by Oji Paper Co., Ltd.) by setting the fixing temperature to 180° C. and setting the process speed to 250 mm/second. Thereafter, an optical microscope (VK9500 manufactured by Keyence Corporation) is used to observe a field of view in a range of 1 cm×34 cm selected from the surface of the photoreceptor (hereinafter, referred to as a photoreceptor surface region), and crack on the surface of the photoreceptor is evaluated by the following criteria.

Evaluation Criteria

G1: Crack having a size of equal to or greater than 1 mm is not observed in the photoreceptor surface region G2: One crack having a size of equal to or greater than 1 mm is formed in the photoreceptor surface region G3: Two or more cracks having a size of equal to or greater than 1 mm are formed in the photoreceptor surface region Evaluation of Gloss Unevenness After the images are continuously printed on the 3,000 coated sheets for the evaluation of crack on the surface of the photoreceptor, gloss in the 100th obtained solid image is measured by a gloss meter GM-26D (manufactured by Murakami Color Research Laboratory Co., Ltd.) under a condition of a light incident angle of 75° with respect to the image.

Gloss measurement points are set at nine points at which three lines that are parallel to the short direction of the coated sheet and are positioned at 3 cm, 8 cm, and 15 cm from one end of the coated sheet in the longitudinal direction and three lines that are parallel to the longitudinal direction of the coated sheet and positioned at 3 cm, 6 cm, and 10 cm from one end of the coated sheet in the short direction intersect each other.

For the evaluation of gloss unevenness, determination is made based on the following criteria in accordance with differences between the maximum values and the minimum values of the gloss at the nine points for measurement. The results will be shown in Tables 3 and 4.

Evaluation Criteria

G1: The difference between the maximum value and the minimum value of gloss is less than 2.0

G2: The difference between the maximum value and the minimum value of gloss is equal to or greater than 2.0 and less than 4.0

G3: The difference between the maximum value and the minimum value of gloss is equal to or greater than 4.0 and less than 10.0

G4: The difference between the maximum value and the minimum value of gloss is equal to or greater than 10.0

TABLE 1

| | Core particle formation process | | | Additional addition (core particle/first shell layer formation process) | | | Additional addition (core particle/first shell layer/second shell layer formation process) | Temperature re-increasing conditions (temperature re-increasing process) | |
|---|---|---|---|---|---|---|---|---|---|
| | Brilliant pigment particle dispersion | | Resin particle | Resin particle | Release agent dispersion | | Resin particle | Temperature increasing speed | Temperature |
| | Type | Part | dispersion/part | dispersion/part | Type | Part | dispersion/part | (° C./minute) | (° C.) |
| Example 1 | (1) | 300 parts | 193 parts | 133 parts | (P1) | 53 parts | 187 parts | 0.05° C./minute | 87° C. |
| Example 2 | (1) | 300 parts | 193 parts | 133 parts | (P1) | 53 parts | 187 parts | 0.01° C./minute | 87° C. |
| Example 3 | (1) | 300 parts | 193 parts | 133 parts | (P1) | 53 parts | 187 parts | 0.5° C./minute | 87° C. |
| Example 4 | (1) | 300 parts | 193 parts | 133 parts | (P1) | 53 parts | 187 parts | 0.05° C./minute | 80° C. |
| Example 5 | (1) | 300 parts | 193 parts | 153 parts | (P1) | 33 parts | 187 parts | 0.05° C./minute | 87° C. |
| Example 6 | (1) | 300 parts | 193 parts | 153 parts | (P1) | 33 parts | 187 parts | 0.5° C./minute | 80° C. |
| Example 7 | (1) | 300 parts | 193 parts | 93 parts | (P1) | 53 parts | 227 parts | 0.05° C./minute | 87° C. |
| Example 8 | (1) | 300 parts | 193 parts | 133 parts | (P2) | 53 parts | 187 parts | 0.05° C./minute | 85° C. |
| Example 9 | (1) | 300 parts | 193 parts | 153 parts | (P2) | 33 parts | 187 parts | 0.5° C./minute | 75° C. |
| Example 10 | (1) | 300 parts | 193 parts | 133 parts | (P3) | 53 parts | 187 parts | 0.05° C./minute | 92° C. |
| Example 11 | (1) | 300 parts | 193 parts | 153 parts | (P3) | 33 parts | 187 parts | 0.5° C./minute | 82° C. |
| Example 12 | (2) | 300 parts | 193 parts | 133 parts | (P1) | 53 parts | 187 parts | 0.05° C./minute | 87° C. |
| Example 13 | (2) | 300 parts | 193 parts | 153 parts | (P1) | 33 parts | 187 parts | 0.5° C./minute | 80° C. |
| Example 14 | (2) | 300 parts | 193 parts | 153 parts | (P2) | 33 parts | 187 parts | 0.05° C./minute | 85° C. |
| Example 15 | (1) | 100 parts | 260 parts | 133 parts | (P1) | 53 parts | 187 parts | 0.05° C./minute | 87° C. |

TABLE 2

| | Core particle formation process | | | Additional addition (core particle/first shell layer formation process) | | | Additional addition (core particle/first shell layer/second shell layer formation process) | Temperature re-increasing conditions (temperature re-increasing process) | |
|---|---|---|---|---|---|---|---|---|---|
| | Brilliant pigment particle dispersion | | Resin particle | Resin particle | Release agent dispersion | | Resin particle | Temperature increasing speed | Temperature |
| | Type | Part | dispersion/part | dispersion/part | Type | Part | dispersion/part | (° C./minute) | (° C.) |
| Comparative Example 1 | (1) | 300 parts | 193 parts | 133 parts | (P4) | 53 parts | 187 parts | 0.05° C./minute | 97° C. |
| Comparative Example 2 | (1) | 300 parts | 193 parts | 133 parts | (P1) | 53 parts | 187 parts | — | — |
| Comparative Example 3 | (1) | 300 parts | 193 parts | 180 parts | (P1) | 7 parts | 187 parts | 0.05° C./minute | 87° C. |
| Comparative Example 4 | (1) | 300 parts | 193 parts | 67 parts | (P1) | 53 parts | 253 parts | 0.05° C./minute | 87° C. |
| Comparative Example 5 | (1) | 300 parts | 193 parts | 133 parts | — | — | 187 parts | 0.05° C./minute | 87° C. |

TABLE 3

| | | | Specific release agent domain | | | | | Evaluation | |
|---|---|---|---|---|---|---|---|---|---|
| | Toner shape | Brilliant pigment shape | Condition (1) Length in longitudinal axis direction (nm) | Condition (2) Length in longitudinal axis direction/length in short axis direction | Condition (3) Angle θ (°) | Condition (4) Distance A/equivalent circle diameter | Rate (% by number) | Crack on surface of photoreceptor | gloss unevenness |
| Example 1 | Flake shape | Flake shape | 1200 nm | 9.0 | 12° | 0.036 | 47% | G1 | G1 |
| Example 2 | Flake shape | Flake shape | 1400 nm | 11.0 | 11° | 0.035 | 49% | G1 | G2 |
| Example 3 | Flake shape | Flake shape | 900 nm | 7.0 | 12° | 0.035 | 36% | G1 | G1 |
| Example 4 | Flake shape | Flake shape | 500 nm | 4.0 | 13° | 0.036 | 35% | G1 | G1 |
| Example 5 | Flake shape | Flake shape | 1200 nm | 9.0 | 11° | 0.035 | 35% | G1 | G1 |
| Example 6 | Flake shape | Flake shape | 500 nm | 4.0 | 12° | 0.036 | 17% | G1 | G2 |
| Example 7 | Flake shape | Flake shape | 1100 nm | 9.0 | 11° | 0.20 | 42% | G1 | G2 |
| Example 8 | Flake shape | Flake shape | 1200 nm | 8.0 | 15° | 0.040 | 45% | G1 | G1 |
| Example 9 | Flake shape | Flake shape | 600 nm | 4.5 | 13° | 0.036 | 21% | G1 | G2 |
| Example 10 | Flake shape | Flake shape | 1300 nm | 10.0 | 11° | 0.036 | 45% | G1 | G2 |
| Example 11 | Flake shape | Flake shape | 600 nm | 4.0 | 15° | 0.037 | 16% | G1 | G2 |

TABLE 3-continued

| | | | Specific release agent domain | | | | | Evaluation | |
|---|---|---|---|---|---|---|---|---|---|
| | Toner shape | Brilliant pigment shape | Condition (1) Length in longitudinal axis direction (nm) | Condition (2) Length in longitudinal axis direction/length in short axis direction | Condition (3) Angle θ (°) | Condition (4) Distance A/equivalent circle diameter | Rate (% by number) | Crack on surface of photoreceptor | gloss unevenness |
| Example 12 | Spherical shape | Spherical shape | 1100 nm | 8.0 | 28° | 0.037 | 37% | G1 | G2 |
| Example 13 | Spherical shape | Spherical shape | 300 nm | 3.0 | 25° | 0.036 | 12% | G1 | G2 |
| Example 14 | Spherical shape | Spherical shape | 1200 nm | 9.0 | 27° | 0.035 | 32% | G1 | G2 |
| Example 15 | Spherical shape | Flake shape | 1200 nm | 9.0 | 26° | 0.036 | 38% | G1 | G2 |

TABLE 4

| | | | Specific release agent domain | | | | | Evaluation | |
|---|---|---|---|---|---|---|---|---|---|
| | Toner shape | Brilliant pigment shape | Condition (1) Length in longitudinal axis direction (nm) | Condition (2) Length in longitudinal axis direction/length in short axis direction | Condition (3) Angle θ (°) | Condition (4) Distance A/equivalent circle diameter | Rate (% by number) | Crack on surface of photoreceptor | gloss unevenness |
| Comparative Example 1 | Flake shape | Flake shape | 100 nm | 1.5 | 42° | 0.042 | 0% | G3 | G4 |
| Comparative Example 2 | Flake shape | Flake shape | 250 nm | 2.0 | 24° | 0.042 | 0% | G3 | G3 |
| Comparative Example 3 | Flake shape | Flake shape | 270 nm | 2.0 | 14° | 0.038 | 0% | G3 | G4 |
| Comparative Example 4 | Flake shape | Flake shape | 1000 nm | 7.0 | 26° | 0.28 | 0% | G3 | G3 |
| Comparative Example 5 | Flake shape | Flake shape | 100 nm | 1.5 | 46° | 0.63 | 0% | G3 | G4 |

Description of Tables 3 and 4

The "angle θ (°)" in the condition (3) means the angle between the tangent line passing through a contact point of a circumference of a circle that is centered at the centroid of the release agent domain and is inscribed in the outer edge of the toner particle and the outer edge and a line passing through the centroid of the release agent domain and extending in the longitudinal axis direction of the release agent domain.

The "distance A/equivalent circle diameter" in the condition (4) means the ratio (distance A/equivalent circle diameter) between the equivalent circle diameter of the toner particle and the distance A between the centroid of the release agent domain and the contact point (the contact point in the condition (3)).

The "rate (% by number) means the rate of the toner particles with the specific release agent domains with respect to the entire toner particles.

From the above results, it is possible to recognize that the occurrence of crack on the surface of the photoreceptor and the gloss unevenness due to the occurrence of the crack on the surface of the photoreceptor are prevented in the examples as compared with the comparative examples.

It is possible to recognize in Examples 4 and 6 in which the specific release agent domains that meet the conditions (1), (2), and (4) with the same values, the gloss unevenness in the fixed image due to the crack on the surface of the photoreceptor is further prevented in Example 4 in which the rate of the toner particles with the specific release agent domains with respect to the entire toner particles is equal to or greater than 30% by number than in Example 6 in which the rate is less than 30%.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A brilliant toner comprising:

toner particles that contain a brilliant pigment and a release agent, wherein the release agent forms release agent domains that meet the following conditions (1) to (4);

Condition (1): a length of the release agent domain in a longitudinal axis direction is from 300 nm to 1,500 nm;

Condition (2): a ratio between the length in the longitudinal axis direction and the length in a short axis direction of the release agent domain (the length in the longitudinal axis direction/the length in the short axis direction) is from 3.0 to 15.0;

Condition (3): an angle θ between (a) a tangent line passing through a contact point of (a1) a circumference of a circle that is centered at a centroid of the release agent domain and is inscribed in an outer edge of the toner particle and (a2) the outer edge and (b) a line passing through the centroid of the release agent domain and extending in the longitudinal axis direction of the release agent domain is from 0° to 45° ; and Condition (4): a ratio of a distance A between the centroid of the release agent domain and the contact point to an equivalent circle diameter of the toner particle (distance A/equivalent circle diameter) is from 0.03 to 0.25.

2. The brilliant toner according to claim 1, wherein a rate of the toner particles with respect to the entire toner particles is equal to or greater than 30% by number.

3. The brilliant toner according to claim 1, wherein the brilliant pigment contains aluminum.

4. The brilliant toner according to claim 1, wherein an aspect ratio of the brilliant pigment is from 5 to 200.

5. The brilliant toner according to claim 1, wherein a melting temperature of the release agent is from 50° C. to 110° C., the toner particles includes a polyester resin having a glass transition temperature of 50° C. to 80° C., and a ratio (Tm/Tg) between a melting temperature (Tm) and a glass transition temperature (Tg) of the release agent is from 1.0 to 2.2.

6. The brilliant toner according to claim 1, wherein the toner particles include a core particle, a first shell layer that covers the core particle, and a second shell layer that covers the first shell layer, and the release agent domains are included in the first shell layer.

7. An electrostatic charge image developer comprising:

the brilliant toner according to claim 1.

8. A toner cartridge comprising:

a container that contains the brilliant toner according to claim 1, wherein the toner cartridge is detachable from an image forming apparatus.

9. The brilliant toner according to claim 1, wherein the toner that has a ratio (A/B) from 2 to 100 between the reflectance A at the light receiving angle of +30° and the reflectance B at the light receiving angle of −30°, measured in a case where a solid image is formed and the solid image is irradiated with incident light with an incident angle of −45° by a varied-angle photometer.

* * * * *